US007371492B2

(12) United States Patent
Ferrar et al.

(10) Patent No.: US 7,371,492 B2
(45) Date of Patent: May 13, 2008

(54) VINYL POLYMER PHOTOCONDUCTIVE ELEMENTS

(75) Inventors: Wayne T. Ferrar, Fairport, NY (US); Xin Jin, Pittsford, NY (US); David S. Weiss, Rochester, NY (US); Michel F. Molaire, Rochester, NY (US); William T. Gruenbaum, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 348 days.

(21) Appl. No.: 11/192,347

(22) Filed: Jul. 28, 2005

(65) Prior Publication Data

US 2007/0026332 A1 Feb. 1, 2007

(51) Int. Cl.
*G03G 5/14* (2006.01)

(52) U.S. Cl. ..... 430/64; 430/123.4

(58) Field of Classification Search ..... 430/64, 430/60, 123.4

See application file for complete search history.

(56) References Cited

U.S. PATENT DOCUMENTS

| | | | |
|---|---|---|---|
| 3,428,451 A | 2/1969 | Trevoy | |
| 4,082,551 A | 4/1978 | Steklenski et al. | |
| 4,971,873 A | 11/1990 | Pavlisko et al. | |
| 5,128,226 A | 7/1992 | Hung | |
| 5,681,677 A | 10/1997 | Bugner et al. | |
| 6,294,301 B1 | 9/2001 | Sorriero et al. | |
| 6,451,956 B2 | 9/2002 | Sorriero et al. | |
| 6,593,046 B2 | 7/2003 | Sorriero et al. | |
| 6,866,977 B2 | 3/2005 | Sorriero et al. | |

FOREIGN PATENT DOCUMENTS

| | | | |
|---|---|---|---|
| JP | 2003-327587 | | 11/2003 |
| JP | 2003-330209 | | 11/2003 |
| JP | 2003330209 A | * | 11/2003 |
| JP | 2004093801 A | * | 3/2004 |

OTHER PUBLICATIONS

Michel Molaire, et al., "Photoconductive Element Having an Amorphous, Polymeric", filed Jul. 9, 2004 as USSN 10/888,172.

* cited by examiner

*Primary Examiner*—Christopher RoDee
(74) *Attorney, Agent, or Firm*—Carl F. Ruoff

(57) ABSTRACT

The present invention is a photoconductive element that includes an electrically conductive support, an electrical barrier layer disposed over said electrically conductive support, and disposed over said barrier layer, a charge generation layer capable of generating positive charge carriers when exposed to actinic radiation. The barrier layer includes a vinyl polymer with aromatic tetracarbonylbisimide side groups and crosslinking sites.

18 Claims, 1 Drawing Sheet

VINYL POLYMER PHOTOCONDUCTIVE ELEMENTS

FIELD OF THE INVENTION

This invention relates to electrophotography. More particularly, it relates to polymers comprising a tetracarbonylbisimide group and to photoconductive elements that contain an electrical charge barrier layer comprised of said polymers.

BACKGROUND OF THE INVENTION

Photoconductive elements useful, for example, in electrophotographic copiers and printers are composed of a conducting support having a photoconductive layer that is insulating in the dark but becomes conductive upon exposure to actinic radiation. To form images, the surface of the element is electrostatically and uniformly charged in the dark and then exposed to a pattern of actinic radiation. In areas where the photoconductive layer is irradiated, mobile charge carriers are generated which migrate to the surface and dissipate the surface charge. This leaves in non-irradiated areas a charge pattern known as a latent electrostatic image. The latent image can be developed, either on the surface on which it is formed or on another surface to which it is transferred, by application of a liquid or dry developer containing finely divided charged toner particles.

Photoconductive elements can comprise single or multiple active layers. Those with multiple active layers (also called multi-active elements) have at least one charge-generation layer and at least one n-type or p-type charge-transport layer. Under actinic radiation, the charge generation layer generates mobile charge carriers and the charge transport layer facilitates migration of the charge carriers to the surface of the element, where they dissipate the uniform electrostatic charge and form the latent electrostatic image.

Also useful in photoconductive elements are charge barrier layers, which are formed between the conductive layer and the charge generation layer to restrict undesired injection of charge carriers from the conductive layer. Various polymers are known for use in barrier layers of photoconductive elements. For example, U.S. Pat. No. 5,128,226 discloses a photoconductor element having an n-type charge transport layer and a barrier layer, the latter comprising a particular vinyl copolymer. U.S. Pat. Nos. 4,082,551 and 3,428,451 disclose a two-layer system that includes cellulose nitrate as an electrical barrier. U.S. Pat. No. 5,681,677 discloses photoconductive elements having a barrier layer comprising certain polyester ionomers. U.S. Pat. No. 4,971,873 discloses solvent-soluble polyimides as polymeric binders for photoconductor element layers, including charge transport layers and barrier layers.

Still further, a number of known barrier layer materials function satisfactorily only when coated in thin layers. As a consequence, irregularities in the coating surface, such as bumps or skips, can alter the electric field across the surface. This in turn can cause irregularities in the quality of images produced with the photoconductive element. One such image defect is caused by dielectric breakdowns due to film surface irregularities and/or non-uniform thickness. This defect is observed as toner density in areas where development should not occur, also known as breakdown.

The known barrier layer materials have certain drawbacks, especially when used with negatively charged elements having p-type charge transport layers. Such elements are referred to as p-type photoconductors. Thus, a negative surface charge on the photoconductive element requires the barrier material to provide a high-energy barrier to the injection of positive charges (also known as holes) and to transport electrons under an applied electric field. Many known barrier layer materials are not sufficiently resistant to the injection of positive charges from the conductive support of the photoconductive element. Also, for many known barrier materials the mechanism of charge transport is ionic. This property allows for a relatively thick barrier layer of previously known barrier materials, and provides acceptable electrical properties at moderate to high relative humidity (RH) levels. Ambient humidity affects the water content of the barrier material and, hence, its ionic charge transport mechanism. Thus, at low RH levels the ability to transport charge in such materials decreases and negatively impacts film electrical properties. A need exists for charge barrier materials that transport charge by electronic as well as ionic mechanisms so that films are not substantially affected by humidity changes.

Condensation polymers of polyester-co-imides, polyesterionmer-co-imides, and polyamide-co-imides are all addressed in:

1. Sorriero et al. in U.S. Pat. No. 6,294,301.
2. Sorriero et al. in U.S. Pat. No. 6,451,956.
3. Sorriero et al. in U.S. Pat. No. 6,593,046.
4. Sorriero et al. in U.S. Pat. No. 6,866,977.
5. Molaire et al. in U.S. patent application Ser. No. 10/888,172.

These polymers have as a repeating unit a planar, electron-deficient, tetracarbonylbisimide group that is in the polymer backbone. The polymers are either soluble in chlorinated solvents and chlorinated solvent-alcohol combinations, or they contain salts to achieve solubility in polar solvents. In all cases, care must be taken not to disrupt the layer with subsequent layers that are coated from solvents, as this may result in swelling of the electron transport layer, mixing with the layer, or dissolution of part or all of the polymer. Furthermore, salts can make the layer subject to unwanted ionic transport. Thus there is a need for polymers with planar, electron-deficient tetracarbonylbisimide groups and do not contain salts that can be coated from solvents, but will not be soluble or miscible with subsequent solvents or layers. Further, there is a need for polymers with planar, electron-deficient tetracarbonylbisimide groups and do not contain salts that can be coated from non-chlorinated solvents. Further, there is a need for polymers with planar, electron-deficient tetracarbonylbisimide groups and do not contain salts that can be coated from solvents, but will not be soluble or miscible with subsequent solvents or layers.

Another disadvantage to the condensation polymers of polyester-co-imides, polyesterionomer-co-imides, and polyamide-co-imides addressed above is they generally consist of monomers other than the planar, electron-deficient tetracarbonylbisimide groups. The level of electron transport agent in the condensation polymers is generally limited because common condensation monomers are also incorporated into the polymer to achieve good mechanical as well as good solubility properties. For example, although the alcohol portion of the polyester may consist of a planar, electron-deficient tetracarbonylbisimide group, the acid portion is generally an aliphatic or aromatic diacid that does not transport charge. It is generally necessary to have the comonomer as a spacer in order to achieve good solubility, even when chlorinated solvents are used. In fact it is difficult to prepare a soluble condensation polymer where all of the diol groups consist of the planar, electron-deficient tetracarbonylbisimide groups. Generally other diols and diacid monomers are used to prepare the polyesters described above. This limits the amount of planar, electron-deficient tetracarbonylbisimide group that can be incorporated into the polymer, and thus limits the amount of charge that can be transported through these layers. The same limitation is true for the polyamides described in the patents above, where the planar, electron-deficient tetracarbonylbisimide group is generally only a fraction of the acid portion used in the polymer, and a common amine that does not transport electronic charge is used as the diamine monomer portion of the polyamide.

Japanese Kokai Tokkyo Koho 2003330209A to Canon includes polymerizable naphthalene bisimides among a number of polymerizable electron transport molecules. Some of the naphthalene bisimides contain acrylate functional groups. The monomers are polymerized after they are coated onto an electrically conductive substrate. However this approach does not ensure the full incorporation of all of the monomers. Some of the functional groups would not react to form a film and could thus be extracted during the deposition of subsequent layers. This would result in a layer that was not the same composition as deposited before polymerization. Further, it would allow for the unwanted incorporation of the electron transport agent into the upper layers of the photoreceptor by contamination of the coating solutions. Thus, the need remains for a well characterized electron transport polymer that can be coated and crosslinked completely to produce a layer that will transport electrons between layers of a photoreceptor without contaminating subsequent layers.

Japanese Kokai Tokkyo Koho 2003327587A to Canon describes the synthesis of naphthalene bisimide acrylate polymers. The polymers were coated from solution onto "aluminum Mylar" and crosslinked to harden the layer to form crack free films. Mobility measurements were made. No layer was coated upon this layer and no crosslinking chemistry for the polymer is described. A photoreceptor is not described. The need exists to form an insoluble film from a polymer that can transport electrons and has active sites for crosslinking that result in a film that can be overcoated with subsequent layers to form a photoreceptor. The crosslinking should be done either thermally or with UV light. The naphthalene bisimide polymer must be completely soluble in the coating solution and crosslink so the layer is intact when subsequent layers are coated upon the naphthalene bisimide layer.

Photoconductive elements typically are multi-layered structures wherein each layer, when it is coated or otherwise formed on a substrate, needs to have structural integrity and desirably a capacity to resist attack when a subsequent layer is coated on top of it or otherwise formed thereon. Such layers are typically solvent coated using a solution with a desired coating material dissolved or dispersed therein. This method requires that each layer of the element, as such layer is formed, should be capable of resisting attack by the coating solvent employed in the next coating step. A need exists for a negatively chargeable photoconductive element having a p-type photoconductor, and including an electrical barrier layer that can be coated from an aqueous or organic medium, that has good resistance to the injection of positive charges, can be sufficiently thick and uniform that minor surface irregularities do not substantially alter the field strength, and resists hole transport over a wide humidity range. Still further, a need exists for photoconductive elements wherein the barrier layer is substantially impervious to, or insoluble in, solvents used for coating other layers, e.g., charge generation layers, over the barrier layer. It would also be an advantage to have polymers that form barriers that can be coated out of non-chlorinated solvents. Solvents such as toluene and alcohols are more desirable environmentally because the vapors are not as noxious as those of chlorinated solvents, and the disposal of the excess coating solutions is not as dangerous if chlorinated solvents are not used. Thus, it is a goal to have a barrier layer that can be manufactured and coated from "green" solvents.

Accordingly, a need exists for a negatively chargeable photoconductive element having a p-type photoconductor, and including an electrical barrier layer that can be coated from an aqueous or organic medium, that has good resistance to the injection of positive charges, can be sufficiently thick and uniform that minor surface irregularities do not substantially alter the field strength, and resists hole transport over a wide humidity range. Still further, a need exists for photoconductive elements wherein the barrier layer that is itself coated from non-chlorinated solvents and is substantially impervious to, or insoluble in, solvents used for coating other layers, e.g., charge generation layers, over the barrier layer.

Photoconductive elements comprising a photoconductive layer formed on a conductive support such as a film, belt or drum, with or without other layers such as a barrier layer, are also referred to herein, for brevity, as photoconductors.

PROBLEM TO BE SOLVED BY THE INVENTION

A need exists for a negatively chargeable photoconductive element having a p-type photoconductor, and including an electrical barrier layer that can be coated from an aqueous or organic medium, that has good resistance to the injection of positive charges, can be sufficiently thick and uniform that minor surface irregularities do not substantially alter the field strength, and resists hole injection and transport over a wide humidity range. Still further, a need exists for photoconductive elements wherein the barrier layer is substantially impervious to, or insoluble in, solvents used for coating other layers, e.g., charge generation layers, over the barrier layer. It would also be an advantage to have polymers that form barriers that can be coated out of non-chlorinated solvents.

SUMMARY OF THE INVENTION

The present invention is a photoconductive element that includes an electrically conductive support, an electrical barrier layer disposed over said electrically conductive support, and disposed over said barrier layer, a charge generation layer capable of generating positive charge carriers when exposed to actinic radiation. The barrier layer polymer in the present invention includes a vinyl polymer that contains an aromatic tetracarbonylbisimide side group, and has the formula:

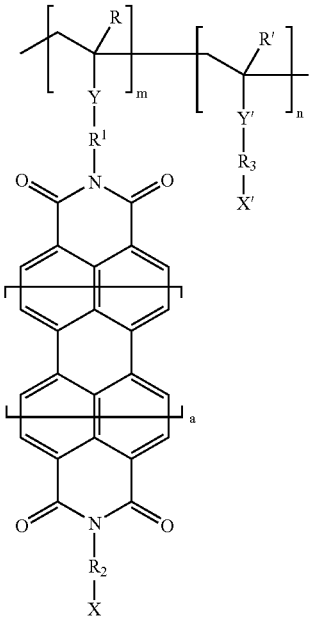

wherein:

a is 0 or 1;

R and R' independently represents H, $CH_3$, $CH_2CO_2R_4$ where $R_4$ represents an alkyl group.

$R_1$ and $R_2$ and $R_3$ independently represent alkylene or alkyleneoxy groups having from about 2 to 12 atoms;

X and X' independently represent H, —OH, —$CO_2H$, —OC(O)CH═$CH_2$;

Y and Y' independently represent bridging moieties such as —$C_6H_4$— and

—OC(O)—

And m and n are numbers between 1 and 100 where m+n=100, representing the mole percentage of monomer repeat units in the polymer. The molecular weight of the polymer is between 5000 and 500,000 amu. Examples of vinyl monomers include acrylates, methacrylates, styrenics, acrylonitrile, itaconates, and acrylamides.

The barrier layer polymers described above are also preferably crosslinkable and substantially insoluble in solvents used for coating the charge generation and charge transport layers over the electrical barrier layer under the coating conditions employed. The preferred acrylate co-imides described below can also generally resist both swelling and solubilization during the time frame for the coating step associated with formation of the charge generation layer due to the incorporation of crosslinking agents.

ADVANTAGEOUS EFFECT OF THE INVENTION

The invention provides for a negatively chargeable photoconductive element having a p-type photoconductor, and including an electrical barrier polymer that has good resistance to the injection of positive charges, can be sufficiently thick and uniform that minor surface irregularities do not substantially alter the field strength, and resists hole transport over a wide humidity range. The barrier polymer is prepared from a vinyl polymer having pendent planar, electron-deficient, tetracarbonylbisimide groups. This barrier polymer is substantially impervious to, or insoluble in, solvents used for coating other layers, e.g., charge generation layers, over the barrier polymer layer. It would also be an advantage to have polymers that form barriers that can be coated out of non-chlorinated solvents that are environmentally friendly.

DETAILED DESCRIPTION OF THE INVENTION

Figure 1:
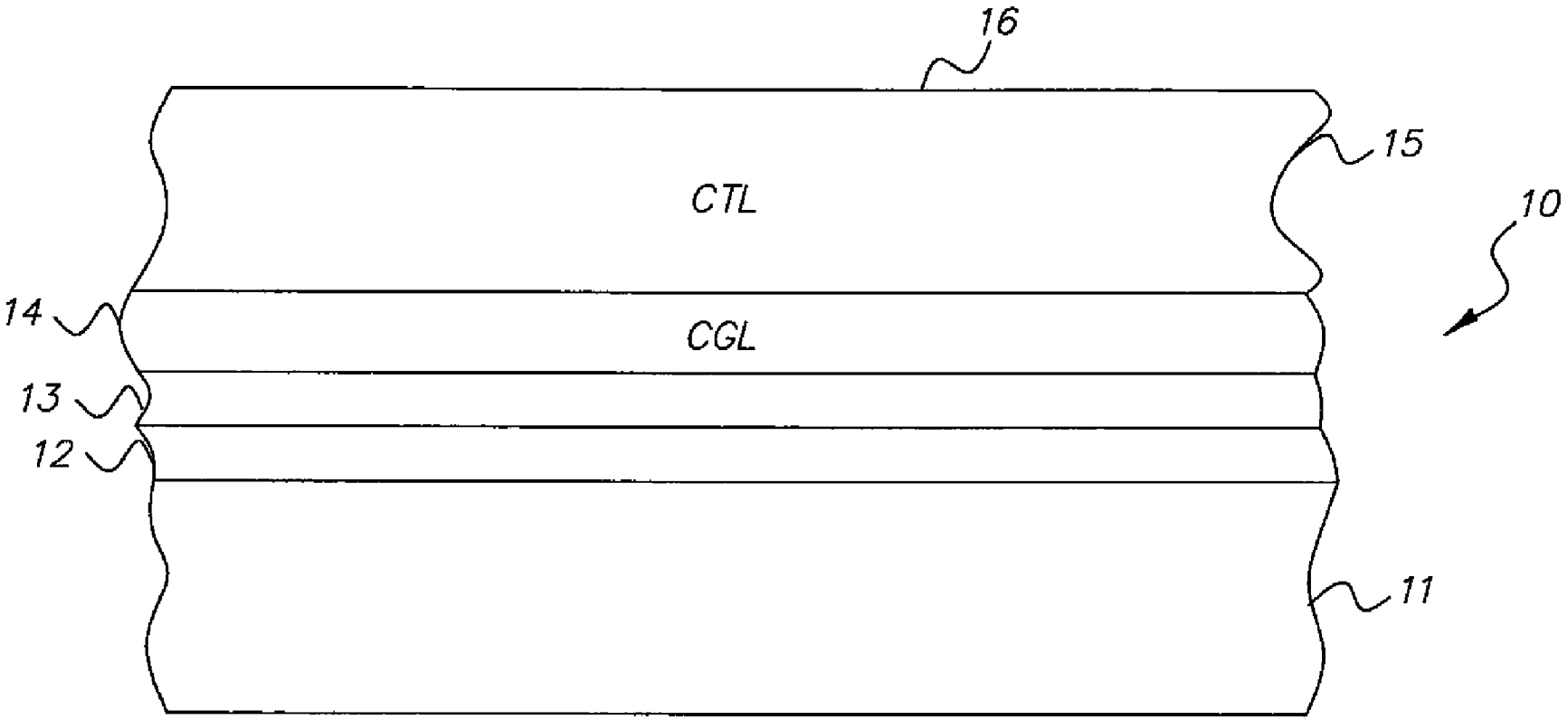
FIG. 1 is a schematic cross section, not to scale, for one embodiment of a photoconductive element according to the invention.

The invention has numerous advantages. As illustrated in FIG. 1, the invention provides a embodiment of a photoconductive element 10 of the invention that comprises a flexible polymeric film support 11. On this support is coated an electrically conductive layer 12. Over the conductive layer 12 is coated a polymeric barrier layer 13, the composition of which is indicated above and described more fully hereinafter. Over the barrier layer 13 is coated a charge generation layer 14, and over the latter is coated a p-type charge transport layer 15. The p-type charge transport layer 15 is capable of transporting positive charge carriers generated by charge generation layer 14 in order to dissipate negative charges on the surface 16 of the photoconductive element 10.

The barrier and other layers of the photoconductive element are coated on an "electrically conductive support," by which is meant either a support material that is electrically conductive itself or a support material comprising a non-conductive substrate, such as support 11 of the drawing, on which is coated a conductive layer 12, such as vacuum deposited or electroplated metals, such as nickel. The support can be fabricated in any suitable configuration, for example, as a sheet, a drum, or an endless belt. Examples of "electrically conductive supports" are described in U.S. Pat. No. 5,681,677, the teachings of which are incorporated herein by reference in their entirety.

The barrier layer composition can be applied to the electrically conductive substrate by coating the substrate with an aqueous dispersion or solution of the barrier layer polymer using, for example, well known coating techniques, such as knife coating, dip coating, spray coating, swirl coating, extrusion hopper coating, or the like. In addition to water, other solvents which are suitable are polar solvents, such as alcohols, like methanol, ethanol, propanol, isopropanol, and mixtures thereof. As indicated in the examples hereinafter, such polar solvents can also include ketones, such as acetone, methylethylketone, methylisobutylketone, or mixtures thereof. After application to the conductive support, the so-coated substrate can be air-dried. It should be understood, however, that, if desired, the barrier layer polymers can be coated as solutions or dispersions in organic solvents, or mixtures of such organic solvents and water, by solution coating techniques known in the art.

Typical solvents for solvent coating a photoconductive charge generation layer over a charge barrier layer are disclosed, for example, in U.S. Pat. No. 5,681,677, U.S. Pat. No. 5,733,695; and U.S. Pat. No. 5,614,342, the teachings of which are all incorporated herein by reference in their entirety. As these references indicate, the photoconductive material, e.g., a photoconductive pigment, is solvent coated by dispersing it in a binder polymer solution. Commonly used solvents for this purpose include chlorinated hydrocarbons, such as dichloromethane, as well as ketones and tetrahydrofuran. A problem with known barrier layer compositions is that such solvents for the coating of the photoconductive or charge generation layer will also dissolve or damage the barrier layer. An advantage of the barrier layer compositions of the invention is crosslinking sites are incorporated into the polymer. After the barriers are crosslinked, they are not substantially dissolved or damaged by chlorinated hydrocarbons or the other commonly used solvents for coating photoconductor or charge generation layers, at the temperatures and for the time periods employed for coating such layers. This is achieved through copolymerization with functional acrylates such as 2-hydroxyethyl acrylate, 2-hydroxyethyl methacrylate, 4-hydroxybutyl acrylate, 4-hydroxybutyl methacrylate, acrylic acid, methacryli cacid, 2-acetoacetoxyethyl methacrylate, N-acryloxysuccinimide, N-acryloyltris(hydroxymethyl)aminomethane, 2-aminoethyl methacrylate hydrochloride, N-(3-aminopropyl) methacrylamide hydrochloride, (3-methylacryloxypropyl)trimethoxysilane, (3-methylacryloxypropyl) methyldimethoxysilane, methacryloxypropyltrimethoxysilane, methacryloxypropyltriethoxysilane, methacryloxypropylmethyldimethoxysilane, and methacryloxypropylmethyldiethoxysilane. In addition, the copolymers with functional acrylates can be further transformed into a pendent acrylate functionality for ultra-violet radiation curing. The crosslinked acrylate copolymers are not substantially dissolved or damaged by chlorinated hydrocarbons or the other commonly used solvents for coating photoconductor or charge generation layers, at the temperatures and for the time periods employed for coating such layers. Styrenic derivatives would also be useful. Preferred monomer for crosslinking sites are the hydroxy acrylates and methacrylates because they have less tendency to interfere with the charge transfer of the bisimides. More than one hydroxyl group may be attached to the polymer per repeat unit by using dihydroxy monomers such as 2,3 dihydroxypropylmethacrylate as a commoner. Alternatively, the hydroxyl group pendent to the naphthalene bisimide ring and linked though a spacer is also effective for crosslinking.

There are many commercial crosslinking agents that will react when heated for a sufficient period of time with an active functional group of an acrylic polymer to form crosslinked networks. Some of the more common methods of thermal crosslinking are listed below.

1. Dihydroxydioxane has been used to crosslink gelatin and polyvinylalcohol. Acid is needed to catalyze the reaction of amines are not present.
2. PRIMIDS™ (Ems-Chemie AG in Domat/Switzerland) are β-hydroxyalkylamides that will react with acrylic acid moieties on an acrylate polymer.
3. CYMEL™ crosslinking agents are highly methylated melamine-formaldehyde resins where the methoxymethyl group react with a hydroxy group on the acrylic polymer.
4. Radical initiators such as benzoyl peroxide that will react at elevated temperatures with pendent olefin and acrylates to form covalent crosslinks.
5. Blocked isocyanate crosslinking agents are used to crosslink hydroxy compounds to form urethanes.
6. Thiol-ene systems that operate by thermal or photocrosslinking and are relatively insensitive to atmospheric oxygen.
7. Diethylmalonate blocked isocyanates are a form of the blocked isocyanates that crosslinks using ester exchange. This differs from other isocyanate blocking chemistry in that the product of the crosslinking is an ester that produces an alcohol, rather than amino compounds which can be formed by the presence of water in conventional blocked-isocyanate crosslinkers. The structure of the crosslinker known BI 7963 from Baxenden Chemicals Limited, Paragon Works, Baxenden, Accrighton, Lancashire BB5 2SL, England is represented as:

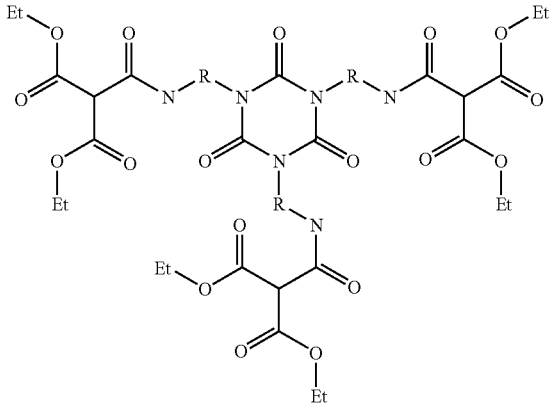

R = $(CH_2)_6$

8. References to crosslinking chemistry include:

Wicks, D. A.; Wicks, Z. W. Prog. Org. Coat. 1999, 36, 148.

Wicks, D. A.; Wicks, Z. W. Prog. Org. Coat. 2001, 41, 1.

Maier, S.; Loontjens, T; Scholtens, B.; Mulhaupt, R.; Macromolecules, 2003, 36, 4727.

Jones, J. Paint & Resin Times 2002, April/May 1(3): 9-11.

Tabor, B. E.; Owers, R.; Janus, J. W.; J. Photographic Science, 1992, 40, 205.

Reddy, S. K.; Cramer, N. B.; Rydholm, A.; Anseth, K. S.; Bowman, C. N.; Polymer Preprints 2004, 45 (2), 65.

Webster, G., Edit. Prepolymers &Reactive Diluents, Volume 11 in Chemistry & Technology of UV & EB Formulations for Coatings, Inks & Paints.

The advantage of crosslinking the bisimide acrylate is that the cured polymer is insoluble in all solvents. Thus the polymer can be overcoated with any solvent system, without regard to the solubility of any subsequent layers of coating.

This is a substantial advantage of previous bisimide polymers prepared by condensation polymerization, where the subsequent layers had to be coated from solvents that would not dissolve the barrier layer. Additionally, mixing of the barrier layer can be minimized or eliminated by controlling the degree of crosslinking in the layer. For example, certain polyamides of the barrier layer polymers of previous invention were dissolved in mixtures of dichloromethane with a polar solvent such as methanol or ethanol. The polyamide barrier layer was "substantially insoluble" in chlorinated hydrocarbons and could be overcoated with solvents such as dichloromethane. However, that solvent could not also contain an alcohol as that would render the imide containing polyamide soluble and result in dissolution of the layer. The barrier layer polymers of the invention are not limited by this restriction and can be overcoated with a wide variety of solvents, including the same solvent as the polymer was originally coated from. For example, the imide acrylate polymers could be coated from THF, cured, and overcoated with THF to deposit a layer such as a charge generation layer on the barrier layer. In a similar manner, the polyesterionomer-co-imide of the previous inventions employ polar solvents to deposit the electron transport barrier layer onto the substrate. Overcoating with subsequent layers is then limited to solvents that will not destroy the polymer or cause mixing with subsequent layers, and thus only non-polar solvents can be used to coat the subsequent layers. This can be a disadvantage as it limits the choice of compounds that can be overcoated onto the barrier layer. It also necessitates the use of organic solvents that are often not as environmentally desirable as polar solvents such as alcohols and water. Thus the crosslinked acrylates allow for much greater levels of choice in the formulations of the photoreceptors.

The compositions of, the locations, and methods for forming the photoconductive charge generating layer, the charge transport layer, and other components of the photoconductive element of the invention can be as described in U.S. Pat. No. 5,681,677 cited above and incorporated herein by reference in its entirety.

A preferred conductive support for use in electrophotographic and laser copiers or printers is a seamless, flexible cylinder or belt of polymer material on which nickel can be electroplated or vacuum deposited. Other useful supports include belts or cylinders with layers of other metals, such as stainless steel or copper, deposited thereon. Such conductive supports have important advantages, but at least one drawback for which the barrier layer compositions of the invention, and particularly certain preferred polyamide-co-imide polymers as described more fully hereinafter, provide a solution. The deposited nickel layers often have bumps or other irregularities which, when the barrier layer is thin, can cause an irregular electric field strength across the surface and thus cause defects, electrical breakdown, or so-called black spots in the resulting image. Thus, irregularities on the electrically conductive support make it desirable to have a barrier layer which can be coated at thicknesses which are adequate to smooth out this surface roughness. As an advantage over conventional barrier materials, the barrier materials of the present invention can be formed in relatively thick layers and still have desired electrophotographic properties. Thus depending on the nature of the substrate surface barrier layers greater than about 5 microns can be utilized with this invention. As a relatively thick layer, e.g., greater than 1 micron and, in more preferred embodiments, greater than 2 microns, preferably greater than about 3 microns, more preferably greater than about 4 microns, and most preferably greater than about 5 microns, the barrier layer of the invention can act as a smoothing layer and compensate for such surface irregularities. In particular, the preferred acrylate-co-polymer contaiing aromatic bisimide described below can be coated as a relatively thick barrier layer, in comparison to those elements exemplified in U.S. Patents of the condensation polymers with planar, electron-deficient tetracarbonylbisimide groups that produce good performance in an electrophotographic film element. The polyacrylate barrier layers can be thicker than barrier layers using the condensation polymers due to the higher loading of the electron transport agent that are possible with the vinyl polymers. In general, the condensation polymers with the electron transport agents are limited to a lower weight percentage of electron transport agent or they become insoluble. In contrast, some acrylates described in this invention are synthesized from in total from the naphthalene bisimide vinyl monomer. These materials have good solubility in organic solvents before they are crosslinked and have superior electron transport properties due to the high loading of the electron transport agent.

We have found that although several of these techniques give satisfactory crosslinking of the bisimide films, the techniques that avoid acids and bases are the most satisfactory for bisimide acrylates that carry charge. One method of crosslinking that we have employed uses diethylmalonate blocked isocyanates. These are a form of the blocked isocyanates that crosslinks using ester exchange. This differs from other isocyanate blocking chemistry in that the product of the crosslinking is an ester and an alcohol, rather than an amino compound or some other more reactive species that could interfere with the charge transport of the polymers. In particular the crosslinking of the polymer below with a diethylmalonate blocked isocyanate results in the formation of ethanol which is volatilized in the curing process.

The barrier layer polymer employed is a vinyl polymer that contains as a repeating unit a planar, electron-deficient aromatic tetracarbonylbisimide group as defined above. The bisimide structure containing the tetravalent-aromatic nucleus can be incorporated as an acrylate by reaction of the corresponding tetracarbonyldianhydride with the appropriate amino-alcohol with acryloyl chloride. The resulting bisimide-acrylates may then by polymerized to prepare the barrier layer polymers by techniques well-known in the art, such as radical polymerization. A preferred technique is solution polymerization as described by Sorensen and Campbell, in "Preparative Methods of Polymer Chemistry," pp. 182-184, Interscience Publishing, Inc. (1961) New York, N.Y. Other methods of vinyl polymerization such as cationic polymerization, anionic polymerization, stereospecific polymerization, and controlled/living radical polymerization are also applicable to these monomers to form polymers of crosslinked networks. Preparation of bisimides is also disclosed in U.S. Pat. No. 5,266,429, previously incorporated by reference. More specifically, in embodiments, the barrier layer polymer comprises an acrylate-co-polymer which contains an aromatic tetracarbonylbisimide group that is copolymerized with a hydroxyacrylate moiety, and has the formula:

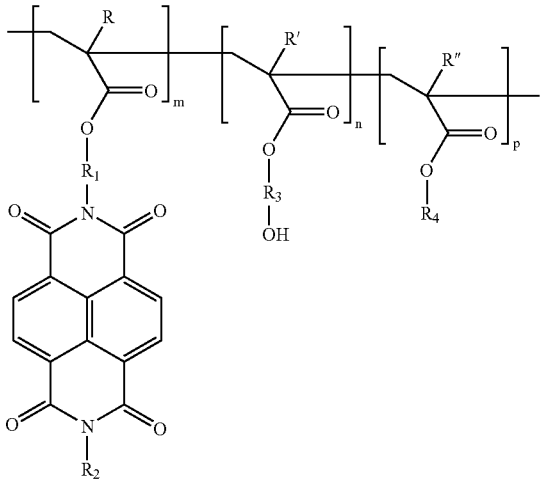

wherein:

R, R', and R" independently represents H or $CH_3$;

$R_1$ and $R_3$ independently represents alkylene or alkyleneoxy groups having from about 2 to 12 atoms;

$R_2$ and $R_4$ independently represent alkyl, alkyl aryl, substituted alkyl, or substituted alkyl aryl.

And m, n and p are numbers between 1 and 100 representing the mole percentage of monomer repeat units in the polymer where m is a number between 50 and 99 and n+p is a number between 1 and 50, where m+n+p=100. The molecular weight of the polymer is between 5000 and 500,000 amu.

More preferable $R_1$ can represent ethylene, propylene, butylene, pentylene, hexylene, octylene, or ethoxyethylene; $R_2$ can represent methyl, ethyl, propyl, butyl, pentyl, hexyl, octyl, or ethoxypropyl; $R_3$ can represent ethylene, propylene, butylene, pentylene, hexylene, octylene, ethoxyethylene, isobutylene, or ethoxyethylene repeated between 1 and 5 times, $R_4$ can represent methyl, ethyl, propyl, butyl, pentyl, hexyl, octyl, or ethoxypropyl, m is a number between 60 and 98 and n+p is a number between 2 and 38 and the molecular weight of the polymer is between 8000 and 200,000 amu.

An example of a more preferable formula based on the above structure is represented as

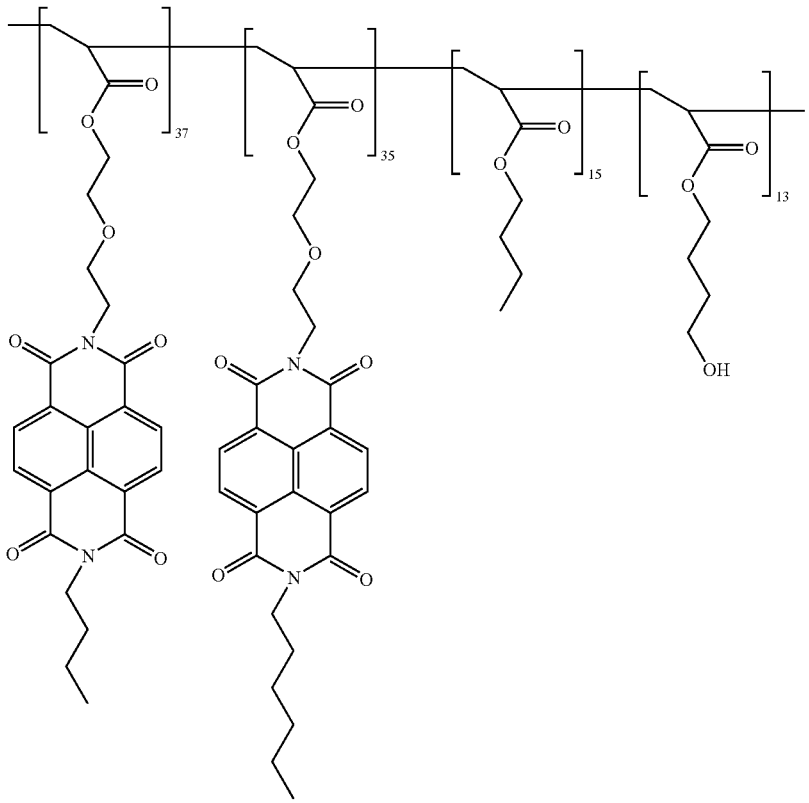

wherein:

R and R' and R" represent H;

$R_1$ represents ethoxyethyl;

$R_2$ represents both butyl and hexyl;

$R_3$ represents butylene;

$R_4$ represents butyl;

m represents 37 and 35;

n represents 13;

p represents 15.

Alternatively, the hydroxyl functionality can be appended from the aromatic bisimide side group as shown below. This polymer has the formula:

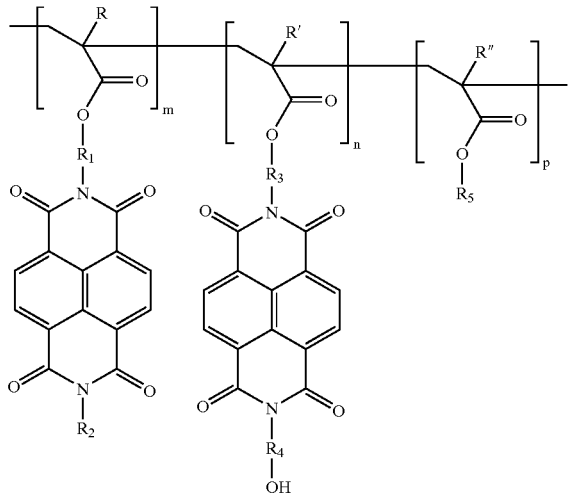

wherein:

R, R' and R" independently represents H or $CH_3$;

$R_1$ and $R_3$ and $R_4$ independently represents alkylene or alkyleneoxy groups having from about 2 to 12 atoms;

$R_2$ and $R_5$ independently represent alkyl, alkyl aryl, substituted alkyl, or substituted alkyl aryl.

And m, n and p are numbers between 1 and 100 representing the mole percentage of monomer repeat units in the polymer where m is a number between 50 and 99 and n+p is a number between 1 and 50. The molecular weight of the polymer is between 5000 and 500,000 amu.

More preferable $R_1$ and $R_3$ can represent ethylene, propylene, butylene, pentylene, hexylene, octylene, or ethoxyethyl; $R_2$ and $R_5$ can represent methyl, ethyl, propyl, butyl, pentyl, hexyl, octyl, or ethoxypropyl; $R_4$ can represent ethylene, propylene, butylene, pentylene, hexylene, octylene, ethoxyethylene isobutylene, or ethoxyethylene repeated between 1 and 5 times, m is a number between 60 and 98 and n is a number between 2 and 40, and the molecular weight of the polymer is between 8000 and 200,000 amu.

This arrangement has the advantage of making the crosslinking site more accessible to the crosslinking agent by placing the hydroxyl crosslinking site further away from the polymer backbone. The sterically demanding aromatic bisimides would be expected to shield the hydroxyl group in the polymers where the hydroxyl acrylates are copolymerized with the aromatic bisimide acrylates, but placing the group at the end of the side group moiety makes it very accessible to attack by the crosslinking agent. Thus the steric hindrance in the first example where a hydroxyl acrylate monomer is copolymerized with the naphthalenebisimide acrylate is minimized in this case because the hydroxyl group is pendent to the bisimide group. This arrangement where the hydroxyl group is appended to the naphthalene bisimide group also has the advantage that the amount of electron deficient aromatic in the polymer can be much higher. All of the monomers in the polymers can be the naphthalene bisimide acrylates and the polymer can still have an abundance of crosslinking sites. Alternatively other vinyl momomers can be copolymerized to make a large variety of copolymers and the amount of aromatic bisimide transport agent can still be relatively high. The aromatic bisimide content of the polymer is higher because the crosslinking site is also a transport site. Thus the efficiency of charge transport of this polymer is expected to be greater. Another advantage of this arrangement where the hydroxyl group is appended to the naphthalene bisimde group is the hydroxyl concentration can be adjusted to any level by incorporating the hydroxyl naphthalene bisimide monomer into the polymerization. Another advantage of this arrangement where the hydroxyl group is appended to the naphthalene bisimide group is the reactivity of the naphthalene bisimide acrylate monomers in polymerization are approximately the same. This results in all of the polymer chains having an equal number of hydroxyl crosslinking sites. All of the polymer chains are more likely to incorporate multiple crosslinking sites. The crosslinking sites are more evenly distributed throughout the polymer because the reactivity ratio of the monomers are more closely matched to each other because the structures are so similar. his allows for a more facile crosslinking reaction with a much higher probability that all of the chains will be incorporated into the crosslinked network. Thus the level of extraction into subsequent layers of the aromatic bisimide is minimized.

An example of a more preferable formula is represented as:

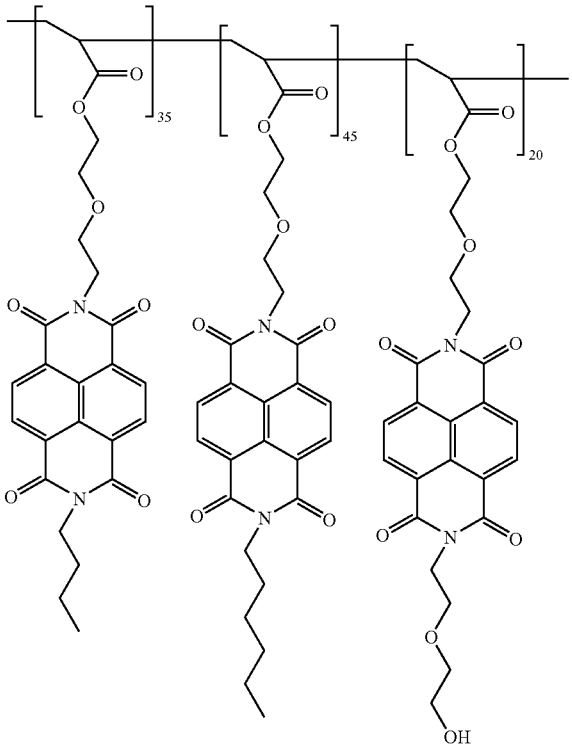

R and R' and R" represent H;

$R_1$ and $R_3$ represent ethoxyethyl;

$R_2$ represents both butyl and hexyl;

$R_3$ represents ethoxyethyl;

$R_4$ represents butyl;

m represents 35 and 45;

n represents 20;

p represents 0.

Although alcohols are the preferred moiety for incorporation of crosslinking sites, other active functional groups that could be use include carboxylicacids, ester, amines, epoxides, and olefins.

UV curing is widely applied in the coating industry and there are numerous advantages for this technology. It is environmentally friendly, cures rapidly within seconds and consumes little energy. In addition, the cost of UV equipment is relatively low and it can improve the efficiency of either web or drum coating processes dramatically compared with the conventional thermal curing process.

There are several kinds of UV curing chemistry, including cationic and radical curing systems. Radical UV curing can be carried out by using a coating formulation that includes photoinitiators and acrylate-co-polymers copolymers which contain an aromatic tetracarbonylbisimide group that is copolymerized with a hydroxyacrylate moiety where the hydroxyacrylate has been transformed into a pendent acrylate functionality, and has the formula:

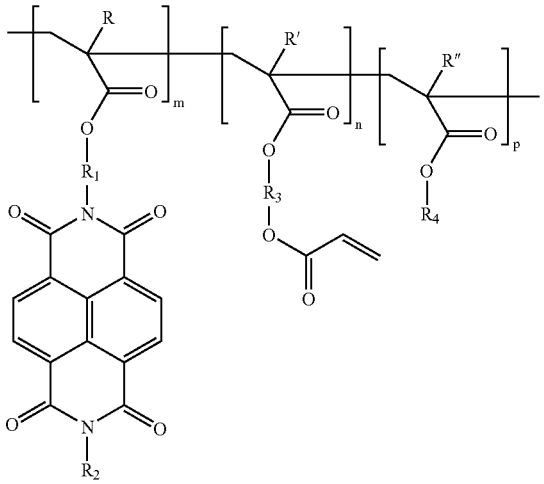

wherein:

R, R', and R" independently represents H or $CH_3$;

$R_1$ and $R_3$ independently represents alkylene or alkyleneoxy groups having from about 2 to 12 atoms;

$R_2$ and $R_4$ represents alkyl, alkyl aryl, substituted alkyl, or substituted alkyl aryl;

And m, n and p are numbers between 1 and 100 representing the mole percentage of monomer repeat units in the polymer where m is a number between 50 and 99 and n+p is a number between 1 and 49, where m+n+p=100. The molecular weight of the polymer is between 5000 and 500,000 amu.

More preferable $R_1$ can represent ethylene, propylene, butylene, pentylene, hexylene; octylene, or ethoxyethylene; $R_2$ and $R_4$ can represent methyl, ethyl, propyl, butyl, pentyl, hexyl, octyl, or ethoxypropyl; $R_3$ can represent ethylene, propylene, butylene, isobutylene, ethoxyethylene repeated between 1 and 5 times, m is a number between 60 and 98 and n+p is a number between 2 and 38, and the molecular weight of the polymer is between 8000 and 200,000 amu.

Coatings of solutions of the above copolymers, photoinitiators, e.g. aromatic ketone, and multi-functional acrylates, which increase curing speed and improve mechanical properties result in polymer films when the solvents are removed. Exposure of the coatings to a UV radiation source rapidly cured the coatings in less than 1 min. The coatings harden during curing and become insoluble in THF and other organic solvents, which are positive indicators of effective crosslinking.

Alternatively, the acrylate functionality can be appended from the aromatic bisimide side group as shown below. This polymer has the formula:

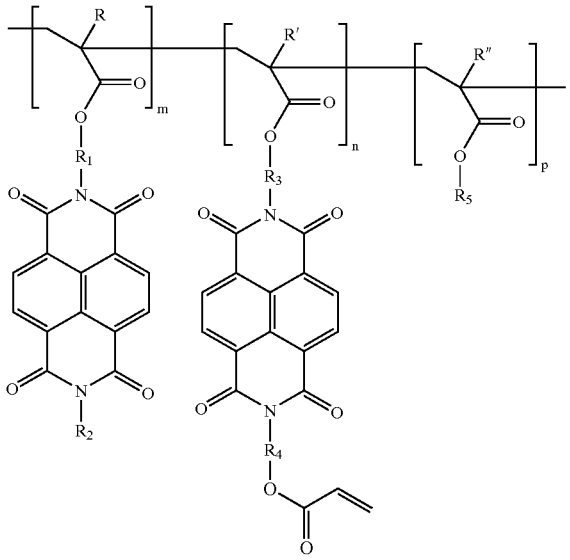

wherein:

R and R' independently represents H or $CH_3$;

$R_1$ and $R_3$ and $R_4$ independently represents alkylene or alkyleneoxy groups having from about 2 to 12 atoms;

$R_2$ and $R_5$ represents alkyl, alkyl aryl, substituted alkyl, or substituted alkyl aryl;

And m and n are numbers between 1 and 100 representing the mole percentage of monomer repeat units in the polymer where m is a number between 50 and 100 and n+p is a number between 0 and 50. The molecular weight of the polymer is between 5000 and 500,000 amu.

More preferable $R_1$ can represent ethyl, propyl, butyl, pentyl, hexyl, octyl, or ethoxyethyl; $R_2$ can represent ethyl, propyl, butyl, pentyl, hexyl, octyl, or ethoxypropyl; $R_3$ can represent methyl, ethyl, butyl, isobutyl, ethoxyethyl repeated between 1 and 10 times, m is an number between 60 and 98 and n is a number between 2 and 38, and the molecular weight of the polymer is between 8000 and 200,000 amu.

The described polymers are all good film formers and exhibit excellent adhesion to most substrates of interest.

These polymers resist attack by the solvent employed for the next film layer, in this case the solvent for the charge generation layer (CGL). Resistance to CGL solvent renders the barrier layer essentially intact and results in controlled thickness as well as reproducible film electrical properties.

It is desirable that the polymer film be amorphous. This is ensured by incorporating more than one type of aromatic bisimide into the polymer structure. For example, a copolymer having bisimide units that terminate with both butyl and hexyl moieties will not crystallize. This results in better film forming properties, a transparent layer, and better electron transport through the coating. The crystallinity of the polymer can be measured by Differential Scanning Calorimetry (DSC). The polymer should be at least partially amorphous as indicated by the presence of the change in the heat capacity of the polymer DSC spectrum.

The crosslinkable vinyl polymers of the invention also yield barrier layers having significantly reduced dielectric breakdown or black spots.

The synthesis of butyl and hexyl naphthalene bisimide acrylates monomers was carried out by modifications of the procedures of Wiederrectht, G. P. and Wasielewski, M. R., J. Am. Chem. Society. 1998, 120, 3231 and in U.S. Pat. Nos. 4,007,192 and 4,118,387.

The synthesis of monofunctionalized aromatic bisimide acrylate monomers from 1,4,5,8-naphthalenetetracarboxylic dianhydride (NTDA) proceeds via the four-steps shown below. Sequential treatment of NTDA with four equivalents of potassium hydroxide and three equivalents of phosphoric acid yields the "monopotassium salt" with a carboxylic acid on C-1, a potassium carboxylate on C-4, and an anhydride bridging C-5 and C-8 of the napthalene ring. The COOH, COOK pair acts as a protecting group and directs the first, unfunctionalized alkyl amine to the anhydride end of the molecule during the second step. Acidification at the conclusion of the second synthetic step generates the anhydride portion of the imide-anhydride compound (NTIA). An aminoalcohol is then reacted with NTIA form the unsymmetrical bisimide. Finally, the alcohol is derivatized with an acid chloride to form the acrylate monomer.

The naphthalenetetracarboxylic dianhydride is reacted with four equivalents of potassium hydroxide to open both anhydride rings of the molecule and form the water soluble tetrapotassium salt. Three equivalents of phosphoric acid are then added to reform the anhydride on one side of the molecule. The acid reacts with the tetrapotassium salt in preference to the dipotassium salt. The desired unsymmetrical product of half salt and half anhydride is formed in high yield. The monopotassium salt can be isolated and stored under normal lab conditions.

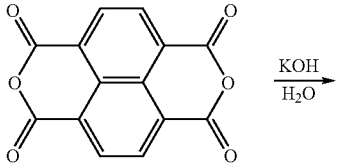

1,4,5,8-Naphthalenetetra-carboxylic dianhydride

-continued

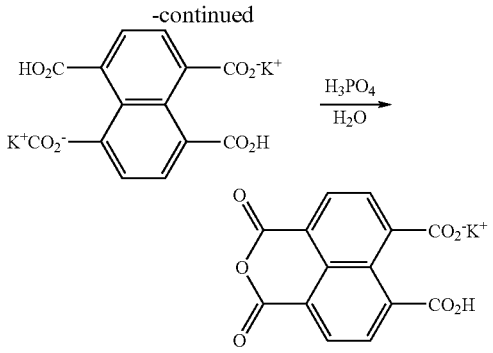

The monopotassium salt is derivatized with an alkyl amine in the second step. Linear alkyl amines are preferred. These include propylamine, butylamine, hexylamine, octylamine, and phenethylamine. The reaction is carried out in water and results in the conversion of the anhydride portion of the molecule into an alkylimide. Hydrochloric acid is then added to reform the anhydride from the salt portion of the molecule. The product is the alkylimide naphthalene anhydride. (It is not possible to use an aminoalcohol in place of the alkylamine to produce an aminoalcohol naphthalene anhydride. The alcohol seems to react with the acid, probably to form an ester. In any event, we have not been able to isolate clean product in this way.)

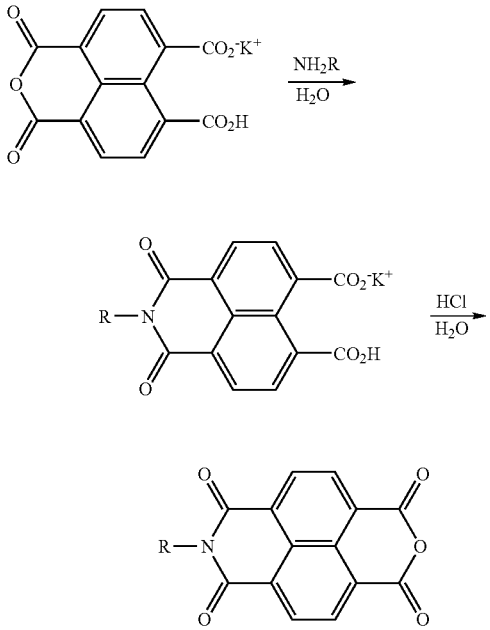

R = butyl or hexyl

The third step in the production of monomer is reaction with a functionalized amine. Aminoalcohols are used for the acrylate monomer precursor. Linear aminoalcohols are preferred, including 2-(2-aminoethoxy)ethanol, 5-amino-1-pentanol, 6-amino-1-hexanol. The reaction is carried out in N-methylpyrrolidinone. The product is a solid naphthalene bisimide with an alcohol functional group at only one end of the molecule. Chromatography is used to purify the product down a short column of silica. The desired molecule is not highly soluble, making purification difficult. The hydroxy-bisimide is loaded onto a short column using dichloromethane, the product collected, and more crude material place on the same column. The product readily elutes and a pure crystalline compound is readily obtained. All other impurities remain on the column.

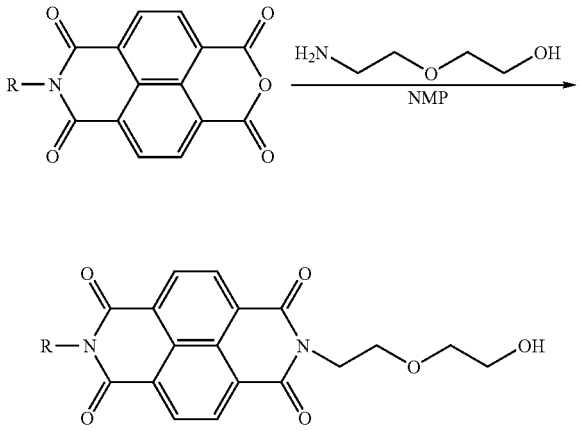

These and other advantages will be apparent from the detailed description below.

The following examples illustrate the practice of this invention. They are not intended to be exhaustive of all possible variations of the invention. Parts and percentages are by weight unless otherwise indicated.

The acrylate or methacrylate group is attached to the bisimide by coupling with acryloyl or methacryloyl chloride. The reaction is carried out in nonpolar solvents such as dichloromethane or tetrahydrofuran in the presence of a base. Dichloromethane is preferred because of the ease of purification. Another simple column is used to ensure the monomer purity. The final product is a crystalline solid that is soluble in nonpolar solvents such as tetrahydrofuran or the chlorinated solvents.

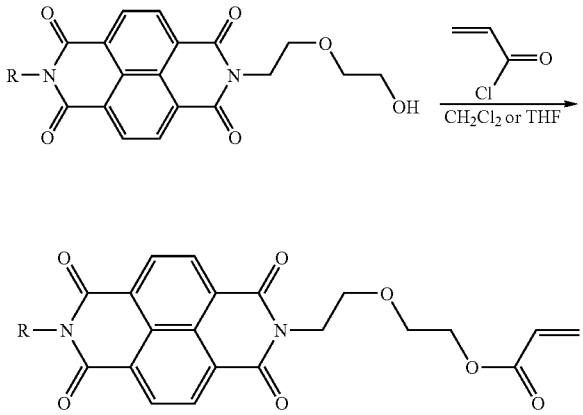

Several unsymmetrical naphthalene bisimides were prepared by the method described above. Other functional groups such as acids could be incorporated into the naphthalene bisimides by using amino acid in place of the amino alcohol.

The synthesis of monofunctionalized aromatic bisimide acrylate monomers that also carry an alcohol functional group was made from NTDA proceeds via the two-steps shown below. The first part is based on the synthesis of the symmetrical naphthalene bisimide. The synthetic scheme is shown below.

Synthesis of 1,4,5,8-naphthalenetetracarbonyl-bis(5-hydroxypentyl)imide (NB5)

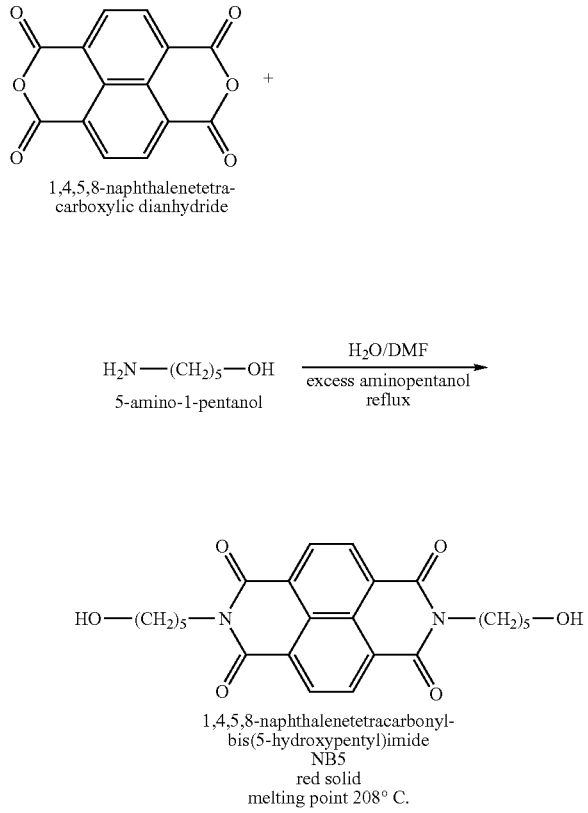

The second part of hydroxy monomer synthesis is diagramed below. The reaction is carried out in 1,4-dioxane in a 3-neck round bottom flask. The starting material is heated in dioxane to form a clear solution and allowed to cool. The solution remains clear. The coupling of one hydroxyl is similar to the one described above using the acryloyl chloride. Purification is carried out with column chromatography to give a clear product in about a 25% yield. We are not yet sure whether the dialkyl or the dialkylether compound is more effective in our polymerization. Nonetheless, the chemistry is essentially the same for both compounds and we are interested in both monomers at the current time. We expect to choose the more useful compound shortly.

Preparation of Hydroxy NB Acrylate

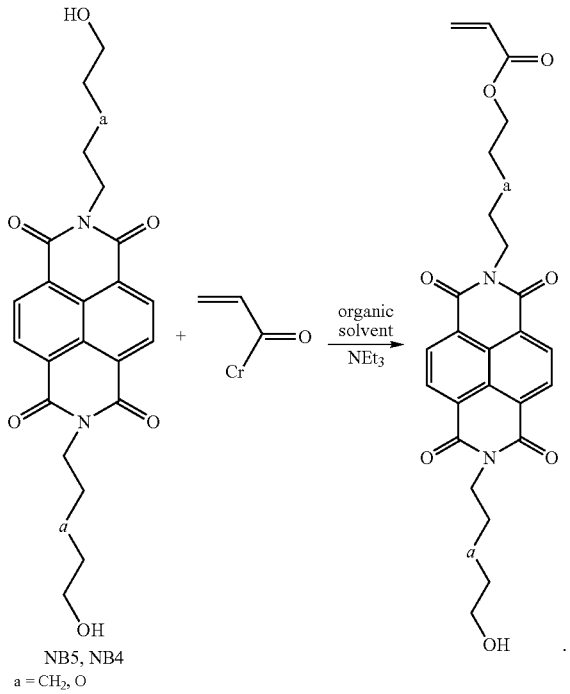

EXAMPLES

Example 1

The invention has been described in detail with particular reference to certain preferred embodiments thereof, but it will be understood that variations and modifications can be effected within the spirit and scope of the invention.

Synthesis of Butyl and Hexyl Naphthalene Bisimide Acrylates.

Step 1. Synthesis of the monopotassium salt (half anhydride). 1-Potassium carboxylate-8-carboxylic acid-naphthalene-4,5-dicarboxylic anhydride. A 12-L four-neck round bottom flask fitted with a mechanical stirrer and a condenser was charged with potassium hydroxide (454 g, 7.60 mol) and water (6.0 L), followed by the addition of 1,4,5,8-naphthalenetetracarboxylic dianhydride (462 g, 1.72 mol). The reaction was stirred for 1 hour and a clear solution resulted. Phosphoric acid, 85% (613 g, 5.2 mol) in water (900 mL) was added over 45 min, the reaction stirred overnight, and the solid product was collected by filtration the next day. Yield is close to 100%.

Step 2. Synthesis of mono-imide. Naphthalenetetracarboxylic-1,8-N-butylimide-4,5-anhydride. A 12-L four-neck round bottom flask fitted with a mechanical stirrer and a condenser was charged with the monopotassium salt (169.2 g, 0.52 mol) described above and water (5.0 L) to give a milky brown dispersion. Butyl amine (240 g, 3.12 mol) was added all at once and a clear amber color solution formed during the addition. The reaction was heated to 90-95° C. for 1 h. Hydrochloric acid (690 mL) of concentrated hydrochloric acid dissolved in water (700 mL) was added dropwise to the hot reaction mixture and the heating was continued for 2 h with care taken not to exceed 95° C. The heat was removed and the reaction stirred overnight at room temperature. The precipitate was collected on a glass frit to give 150 g of the desired naphthalene butylimide monoanhydride, approximately a 90% yield.

Step 3. Synthesis of bisimide. N-Butyl-N'-[2-(2-hydroxyethoxy)-ethyl]-1,4,5,8-naphthalenetetracarboxylic diimide. A 12-L four-neck round bottom flask fitted with a mechanical stirrer and a condenser was charged with naphthalene butylimide monoanhydride (453 g, 1.40 mol) described above, 2-(2-aminoethoxy)ethanol (230 g, 2.2 mol) and NMP (1.2 L). The reaction was heated to 140-150° C. for 3 h, the heating mantle removed and the reaction allowed to cool for 30 min. The reaction flask was filled with methanol and a pink solid precipitated. The reaction was stirred overnight and the solid collected on a glass frit to give 522 g of crude product (90% yield).

Purification was carried out by "filtration" chromatography using silica gel 6200 A particle size (775 g) on a column 12 cm wide by 60 cm long eluted with dichloromethane. Part of the crude product (100 g) was slurried with dichloromethane (4 L) and placed on top of the column. Dichloromethane was used to wash the product through the column until the solution collected turns from dark to light amber (6 L dichloromethane). Thin layer chromatography was used to monitor the column progress, the pure product moving half way up the plate using dichloromethane/ethyl acetate 1/1. The process was repeated until all the material had been purified, a total of 313 g product, approximately a 54% yield.

Step 4. Coupling of the naphthalene bisimide alcohol with acryloyl chloride. N-Butyl-N'-[2-(ethoxy-2-acrylate)ethyl]-1,4,5,8-naphthalenetetracarboxylic diimide. A 5-L four-neck round bottom flask fitted with a mechanical stirrer, a condenser and an nitrogen inlet was charged with the hydroxyether naphtalene butyl bisimide(246 g, 0.6 mol) and triethylamine (73 g, 0.72 mol, 100 mL) in dichloromethane (2 L). Acryloyl chloride (63 g, 0.7 mol, 57 mL) in dichloromethane (150 mL) was added dropwise which solubilized the reactants and the reaction stirred at room temperature overnight. The reaction was placed into a separatory funnel and washed with 5% hydrochloric acid (200 mL), which forms an emulsion. Methanol (100 mL) is added to break the emulsion and separate the layers. Additional methanol may be added if necessary. The organic layer is washed with water and methanol, dried with magnesium sulfate, filtered and concentrated on a rotary evaporator to 500 mL. The product was placed on a silica gel column in dichloromethane for chromatography, ligroin/DCM (1/1) used first to wash impurities from the product, then the amount of DCM increased until the product eluted with 100% DCM to give the desired product (231 g) as a yellow-orange crystalline solid, 83% yield. A single spot was observed by TLC with DCM/ethyl acetate 1/1. Melting point 110° C. in the second heat by DSC.

Synthesis of bis(hydroxypentyl)naphthalene bisimide. N,N'-Bis-(5-hydroxypentyl)-1,4,5,8-naphthalenetetracarboxylic diimide. A 12-L, three neck round bottom flask was charged with 1,4,5,8-naphthalenetetracarboxylic dianhydride(260 g, 0.97 mol) and water (5.8 L) and stirred at room temperature for 30 minutes before adding 5-amino-1-pentanol (500 g, 4.85 mol) in a slow stream. The mixture was heated was heated on a steam bath at 30° C. Until a dark brown burgundy solution formed. The contents were then heated to 60° C. for 5 hours during which a solid phase separated. The contents were cooled to room temperature and the solid was collected by filtration and washed with methanol. The pink-red solid was recrystallized from dimethylformamide to give 300 g of pink solid, melting point of 210-211° C. m/e 438.

Synthesis of hydroxyalkyl naphthalene bisimide acrylate. N-(5-Hydroxypentyl)-N'-(1-pentyl-5-acrylate)-1,4,5,8-naphthalenetetracarboxylic diimide. A 5-L four neck round bottom flask was charged with N,N'-Bis-(5-hydroxypentyl)-1,4,5,8-naphthalenetetracarboxylic diimide (43.8 g, 0.10 mol) and dioxane (1.8 L) and heated to 60° C. to form a clear solution. The reaction was cooled to 40° C. and triethylamine (10.1 g, 0.10 mol) was added, followed by the addition of acryloyl chloride (9.05 g, 0.10 mol). The reaction was stirred for 1 h, filtered, washed with dilute hydrochloric acid, water, and saturated aqueous sodium chloride, dried over magnesium sulfate, filtered and concentrated to give an orange powder, melting point 153° C. in the second heat by DSC.

Comparative Example 1

A multiactive photoconductive film comprising a conductive support, a barrier layer, a charge generation layer (CGL), and a charge transport layer (CTL), coated in that order, is prepared from the following compositions and conditions.

A barrier layer of Amilan™ CM8000 polyamide having no planar tetracarbonylbisimide repeating unit is coated on nickelized poly(ethylene terephthalate), at a dry coverage of 0.05 g/ft$^2$. The barrier layer coating solution is 2.5 wt % in a 65/35 (wt/wt) mixture of ethanol and dichloromethane, with a coating surfactant, SF1023, available from General Electric Company, added at a concentration of 0.003 wt % of the total solution.

A second layer (CGL) is coated on the barrier layer at a dry coverage of 0.05 g/ft$^2$. The CGL mixture comprised 50% of a 75/25 co-crystalline pigment mixture of titanylpthalocyanine and titanyl tetrafluorophthalocyanine, prepared substantially as described in U.S. Pat. Nos. 5,614,342 and 50% of a polyester ionomer binder, poly[2,2-dimethyl-1,3-propylene-co-oxydiethylene (80/20) isophthalate-co-5-sodiosulfoisophthalate(95/5)] prepared substantially as described in U.S. Pat. No. 5,733,695. The CGL mixture is prepared at 3 wt % in a 65/35 (wt/wt) mixture of dichloromethane and 1,1,2-trichloroethane, as described in U.S. Pat. No. 5,614,342. A leveling agent, DC510 available from Dow-Corning Company of Midland, Mich. is added at a concentration of 0.019 wt % of the total solution.

A third layer (CTL) is coated onto the CGL at a dry coverage of 2.3 g/ft$^2$. The CTL mixture comprised 50-wt % Makrolon 5705, 10% poly[4,4'-(norbornylidene) bisphenol terephthalate-co-azelate (60/40)], 20 wt % of 1,1-bis[4-(di-4-tolylamino)phenyl]cyclohexane, and 20 wt % tri-(4-tolyl) amine. The CTL mixture is prepared at 10 wt % in dichloromethane. A coating surfactant, DC510, is added at a concentration of 0.016 wt % of the total mixture.

The amount of hydroxyl incorporation into the polymer was determined by derivativizing the hydroxyl groups with a fluorinated reagent. The fluorine concentration was determined by NMR. The samples were analyzed in replicate, separate sample preparations. The $^{19}$F NMR analyses were performed at an observe frequency of 282.821 MHz, ambient temperature, and $CDCl_3$ was the solvent. The samples were derivatized with trifluoroacetylimidazole (TFAI), which converts the hydroxyl groups to fluorinated ester groups. Trifluorotoluene (TFT) was used as an internal reference, thus allowing quantification by $^{19}$F NMR.

Polymer 1

Poly{N-butyl-N'-[2-(ethoxy-2-acrylate)ethyl]-1,4,5,8-naphthalene-tetracarboxylic diimide}$_{34}${N-hexyl)-N'-[2-(ethoxy-2-acrylate)ethyl]-1,4,5,8-naphthalenetetracarboxylic diimide}$_{33}$[butyl acrylate]$_{28}$[hydroxybutyl acrylate]$_5$. A 250-mL three neck round bottom flask with a magnetic stir bar was charged with was charged with N-butyl-N'-[2-(ethoxy-2-acrylate)ethyl]-1,4,5,8-naphthalenetetracarboxylic diimide (7.74 g, 16.7 mmol), N-hexyl-N'-[2-(ethoxy-2-acrylate)ethyl]-1,4,5,8-naphthalenetetracarboxylic diimide (8.1 g, 16.5 mmol), butyl acrylate (1.8 g, 14 mmol), 4-hydroxybutylacrylate (0.36 g, 2.5 mmol). The flask was flushed with argon, toluene added (30 mL), and the flask heated in an oil bath at 85° C. to form a clear solution. The initiator 1,1'-azobis(cyclohexanecarbonitrile)(Vazo™ 88)(0.15 g) was added in a toluene solution (3 mL) and the heating continued for 18 h. The reaction was allowed to cool, tetrahydrofuran (60 mL) added, and the polymer precipitated into methanol. The product (15.2 g) was precipitated a second time from tetrahydrofuran (100 mL) into methanol/ethyl acetate (1/l)vol. The polymer was an orange powder. $M_n$ 15,800, $M_w$ 32,400, $T_g$ 76° C., hydroxyl number 0.15 meq/g.

Example 1

A photoconductive element is prepared substantially as described in Comparative Example 1, except that the barrier layer polymer is Polymer 1. The barrier layer solution is prepared at 10 wt % in tetrahydrofuran. The crosslinking agent and catalyst amounts were added as shown below in Table 1.

TABLE 1

Formulation of Polymer 1

| Lot no. | Solids | Amilan ™ Control | Formulation 1 |
|---|---|---|---|
| Amilan ™ CM8000 | Amilan ™ | 30 g | |
| Polymer 1 | 0.917% | | 11.004 g |
| Trixene BI 7963 | 0.080% | | 0.96 g |
| K-kot Xc-C227 | 0.003% | | 0.036 g |
| TOTAL WEIGHT | | 30 g | 12 |
| Surfactant | SF1023 | 10 drops | |

Trixene BI 7963 and K-kot Xc-C227 were obtained from Baxenden Chemicals Limited, Paragon Works, Baxenden, Nr. Accrington, Lancashire. BB5 2SL, United Kingdom. The Polymer 1 layer was web coated at a dry coverage of 0.05, 0.10, 0.20, and 0.30 g/ft$^2$, the Amilan™ layer at 0.05 g/ft$^2$. The samples were cured at 135° C. for 24 hours. They were overcoated with CGL and CTL as described in Comparative Example 1.

Evaluation

The films are tested in a laboratory apparatus that charges, exposes and erases the film continuously. The initial and residual or "toe" voltage at the beginning of the test and after 10,000 cycles is recorded for each film. NB stands for the naphthalene bisimide formulation of Polymer 1. The results listed in Table 2 show that the photoconductive elements corresponding to examples of the invention outperform those of the comparative examples.

TABLE 2

Unexposed ($V_0$) and Exposed ($V_{toe}$) Voltages at Different Environments

| Barrier Polymer | Thickness (micron) | Cycle 2 (volts) $V_0$ | Cycle 2 (volts) $V_{toe}$ | Cycle 10,000 (volts) $V_0$ | Cycle 10,000 (volts) $V_{toe}$ |
|---|---|---|---|---|---|
| | | 25° C./20% RH | | | |
| Amilan ™ | 0.5 | −551 | −40 | −540 | −155 |
| NB | 0.5 | −536 | −39 | −513 | −47 |
| NB | 1.0 | −525 | −34 | −499 | −47 |
| NB | 2.0 | −533 | −47 | −509 | −74 |
| NB | 3.0 | −540 | −83 | −519 | −158 |
| | | 25° C./50% RH | | | |
| Amilan ™ | 0.5 | −551 | −40 | −540 | −155 |
| NB | 0.5 | −536 | −39 | −513 | −47 |
| NB | 1.0 | −525 | −34 | −499 | −47 |
| NB | 2.0 | −533 | −47 | −509 | −74 |
| NB | 3.0 | −540 | −83 | −519 | −158 |
| | | 25° C./80% RH | | | |
| Amila ™ | 0.5 | −545 | −40 | −523 | −95 |
| NB | 0.5 | −549 | −41 | −530 | −61 |
| NB | 1.0 | −534 | −38 | −512 | −68 |
| NB | 2.0 | −546 | −67 | −532 | −138 |
| NB | 3.0 | −552 | −108 | −534 | −210 |

Polymer 2

Poly{N-butyl-N'-[2-(ethoxy-2-acrylate)ethyl]-1,4,5,8-naphthalene-tetracarboxylic diimide}$_{37}${N-hexyl-N'-[2-(ethoxy-2-acrylate)ethyl]-1,4,5,8-naphthalenetetracarboxylic diimide}$_{35}$[butyl acrylate]$_5$[hydroxybutyl acrylate]$_{13}$. A 250-mL three neck round bottom flask with a magnetic stir bar was charged with N-butyl-N'-[2-(ethoxy-2-acrylate) ethyl]-1,4,5,8-naphthalenetetracarboxylic diimide (16.2 g, 34.9 mmol), N-hexyl-N'-[2-(ethoxy-2-acrylate)ethyl]-1,4,5,8-naphthalenetetracarboxylic diimide(16.2 g, 33.5 mmol), butyl acrylate (1.8 g, 14.0 mmol), 4-hydroxybutylacrylate (1.8 g, 12.5 mmol). The flask was flushed with argon, toluene added (33 mL), and the flask heated in an oil bath at 95° C. to form a clear solution. The initiator 1,1'-azobis (cyclohexanecarbonitrile)(Vazo™ 88) (0.50 g) was added in a toluene solution (3 mL) and the heating continued for 18 h. The reaction was allowed to cool, tetrahydrofuran (200 mL) added, and the polymer precipitated into methanol/ethyl acetate (1/1)vol. The product was precipitated a second time from tetrahydrofuran (200 mL) into methanol/ethyl acetate (1/1)vol. The polymer (29.5 g) was pink powder. Mn 12,100, Mw 23,100, Tg 77° C., hydroxyl number 0.32 meq/g.

Example 2

A photoconductive element is prepared from Polymer 2 for use in dip coating. The barrier layer solution is prepared at 10 wt % in toluene. The crosslinking agent and catalyst amounts were added as shown in Table 3. An Amilan™ control prepared by web coating as described in Comparative Example 1 was overcoated in the same way as Polymer 2.

TABLE 3

Formulation of Polymer 2

| Component | Weight (g) |
|---|---|
| Polymer 2 | 26.7 |
| Trixene BI 7963 | 3 |
| K-kot Xc-C227 | 0.3 |
| Toluene | 270 |

The toluene solution contained 10 wt % solids of a total solution weight of 300 g or a total solution volume of 344 mL.

Nickel coated polyethylene terephthalate (7 mil) was dip coated into the solution of Polymer 2 and cured at 130° C. for 1 hour to give a dry layer of 0.65 microns. The polymer film was dipped a second time in the Polymer 2 solution to give a dry layer of 1.4 microns after curing. The process was repeated a third time to produce a total film thickness of 2 microns.

The barrier layers were dipped into the CGL and CTL solutions to make films essentially of the same structure as described in Comparative Example 1. The coatings were made into loops and analyzed in a Regeneration Sensitometer at various temperatures and humidities (Table 4). Control samples of a half micron Amilan™ that were web coated as described for the control of Polymer 1 were also dip coated with CGL and CTL and used as a comparison.

TABLE 4

Unexposed ($V_0$) and Exposed ($V_{toe}$) Voltages at 20 C/20% RH

| Cycle | Amilan ™ $V_0$ (volts) | Amilan ™ $V_{toe}$ (volts) | Polymer 2 $V_0$ (volts) | Polymer 2 $V_{toe}$ (volts) |
|---|---|---|---|---|
| 1 | −570 | −40 | −520 | −40 |
| 1000 | −590 | −100 | −530 | −45 |
| 2000 | −600 | −140 | −560 | −50 |
| 3000 | −610 | −150 | −580 | −50 |
| 4000 | −600 | −160 | −560 | −50 |
| 5000 | −590 | −170 | −570 | −50 |
| 6000 | −580 | −180 | −540 | −50 |
| 7000 | −570 | −190 | −540 | −50 |
| 8000 | −580 | −200 | −550 | −50 |

Polymer 3

Poly{N-butyl-N'-[2-(ethoxy-2-acrylate)ethyl]-1,4,5,8-naphthalenetetra-carboxylic diimide}$_{37}$ {N-hexyl-N'-[2-(ethoxy-2-acrylate)ethyl]-1,4,5,8-naphthalenetetracarboxylic diimide}$_{35}$[butyl acrylate]$_{15}$[hydroxybutyl acrylate]$_{13}$. A 250 mL three neck round bottom flask with a magnetic stir bar was charged with {N-(n-butyl)-N'-[2-(ethoxy-2-acrylate)ethyl]-1,4,5,8-naphthalenetetracarboxylic diimide} (16.2 g, 34.9 mmol), {N-(n-hexyl)-N'-[2-(ethoxy-2-acrylate) ethyl]-1,4,5,8-naphthalenetetracarboxylic diimide} (16.2 g, 33.5 mmol), butylacrylate (1.8 g, 14.0 mmol), 4-hydroxybutylacrylate (1.8 g, 12.5 mmol). The flask was flushed with argon, toluene added (33 mL), and the flask heated in an oil bath at 95° C. to form a clear solution. The initiator 1,1'-azobis(cyclohexanecarbonitrile) (Vazo™ 88) (0.50 g) was added in a toluene solution (3 mL) and the heating continued for 18 h. The reaction was allowed to cool, tetrahydrofuran (200 mL) added, and the polymer precipitated into methanol/ethyl acetate (1/1)vol. The product was precipitated a second time from tetrahydrofuran (200 mL) into methanol/ethyl acetate (1/1)vol. The polymer (29.5 g) was pink powder. Mn 11,500, Mw 21,300, Tg 78° C. hydroxyl number 0.32 meq/g.

Example 3

Extraction of Naphthalenebisimide from Crosslinked Coatings

A photoconductive element is prepared from Polymer 3 for use in dip coating. The barrier layer solution is prepared at 10 wt % in tetrahydrofuran. The crosslinking agent and catalyst amounts were added as shown in Table 5. An Amilan™ control prepared by web coating as described in Comparative Example 1 was overcoated in the same way as Polymer 3.

TABLE 5

Formulation of Polymer 3

| Component | Weight (g) |
|---|---|
| Polymer 3 | 24.92 |
| Trixene BI 7963 | 2.8 |
| K-kot Xc-C227 | 0.28 |
| THF | 252 |

The tetrahydrofuran (THF) solution contained 10 wt % solids of a total solution weight of 280 g or a total solution volume of 249 mL.

Dip coatings of Polymer 3 were prepared in the same manner as for Polymer 2 except the substrate was either nickel or nickel overcoated with a 1 micron thick tin oxide/polyurethane smoothing layer. The total thickness after 3 dips was 1.7 microns.

The efficiency of crosslinking was examined by curing the samples for 1, 2, 4, and 24 hours at 130, 150, and 170° C. Equal sized samples were extracted with 1,1,2-trichloroethane (1,1,2-TCE) for 3 minutes and the UV/Visible spectrum of the supernatant obtained to determine the amount of material that remained soluble after crosslinking. The absorbance at 380 nm is characteristic of the naphthalene bisimide moiety. The approximate thicknesses of the Polymer 3 layers were determined from analysis of the interference patterns using an estimate for the refractive index of the material. The results are shown in Table 6A for the nickel substrate and in Table 6B for the smoothing layer on nickel substrate as defined in US Patent Application Publication No. US2005/0142473 A1.

TABLE 6A

Extraction of Uncrosslinked Naphthalene Bisimide Moieties from Coating on Nickel Substrate
Extraction with 1,1,2-TCE for 3 min - on nickel

| Sample # | Hours Cure | Thick-ness | Cure C | Fresh thickness (um) | Sample dried thickness (um) | Supernatant absorbance units |
|---|---|---|---|---|---|---|
| 1 | 1 | 0.6 | 140 | 0.76 | 0.56 | 0.7 |
| 5 | 2 | 1.2 | 140 | 1.22 | 1.04 | 0.8 |
| 7 | 4 | 0.6 | 140 | 0.87 | 0.75 | 0.26 |
| 12 | 24 | 1.8 | 140 | 2.07 | 2.24 | 0.45 |
| 27 | 1 | 1.8 | 155 | 1.81 | 1.76 | 0.8 |
| 28 | 2 | 0.6 | 155 | 0.76 | 0.66 | 0.2 |
| 32 | 4 | 1.2 | 155 | | | |
| 35 | 24 | 1.2 | 155 | 1.71 | 1.71 | 0.18 |
| 50 | 1 | 1.2 | 170 | 1.45 | 1.44 | 0.18 |
| 54 | 2 | 1.8 | 170 | 2 | 2.12 | 0.35 |
| 57 | 4 | 1.8 | 170 | 2.32 | 2.33 | 0 |
| 58 | 24 | 0.6 | 170 | 0.64 | 0.73 | 0 |

TABLE 6B

Extraction of Uncrosslinked Naphthalene Bisimide Coatings on Smoothing Layer on Nickel Substrate
Extraction with 1,1,2-TCE for 3 min - on nickel

| Smooth-ing/ Ni # | Hours Cure | Thick-ness | Cure C | Fresh thick-ness (um) | Sample dried thickness (um) | Supernatant absorbance units |
|---|---|---|---|---|---|---|
| 13 | 1 | 0.6 | 140 | 1.85 | 1.67 | 0.7 |
| 17 | 2 | 1.2 | 140 | 2.4 | 2.24 | 1.2 |
| 19 | 4 | 0.6 | 140 | 1.71 | 1.65 | 0.42 |
| 24 | 24 | 1.8 | 140 | 2.81 | 2.9 | 0.25 |
| 39 | 1 | 1.8 | 155 | 2.95 | 3.13 | 0.18 |
| 40 | 2 | 0.6 | 155 | 1.82 | 1.83 | 0.35 |
| 44 | 4 | 1.2 | 155 | 2.39 | 2.37 | 0.23 |
| 47 | 24 | 1.2 | 155 | 2.44 | 2.51 | 0.18 |
| 62 | 1 | 1.2 | 170 | 2.33 | 2.27 | 1.16 |
| 66 | 2 | 1.8 | 170 | 3 | 3.11 | 0.31 |
| 69 | 4 | 1.8 | 170 | 2.97 | 3.12 | 0.21 |
| 70 | 24 | 0.6 | 170 | 1.52 | 1.56 | 0.07 |

The above extraction results show that the amount of Polymer 3 moiety extracted decreases as the curing temperature and time is increased. This is true when the sample is coated on either nickel or on a 1 micron smoothing layer of tin oxide. This crosslinking of the barrier layer prevents the mixing of other layers of the photoreceptor. It also ensures the integrity of the coating throughout the coating process. A fully cured layer does not change thickness during the coating operation and the uniformity of the barrier layer is ensured. Additionally, the subsequent layers are not contaminated with the napthalene bisimide moieties. Thus it is very desirable to have an electron transport layer that is not deleteriously affected by the other layers of the photoreceptor.

Polymer 4

Poly{N-butyl-N'-[2-(ethoxy-2-acrylate)ethyl]-1,4,5,8-naphthalenetetra-carboxylic diimide}$_{37}${N-hexyl-N'-[2-(ethoxy-2-acrylate)ethyl]-1,4,5,8-naphthalenetetracarboxylic diimide}$_{35}$[butyl acrylate]$_{21}$[hydroxybutyl acrylate]$_8$ A 250-mL three neck round bottom flask with a magnetic stir bar was charged with {N-(n-butyl)-N'-[2-(ethoxy-2-acrylate)ethyl]-1,4,5,8-naphthalenetetracarboxylic diimide} (16.2 g, 34.9 mmol), {N-(n-hexyl)-N'-[2-(ethoxy-2-acrylate) ethyl]-1,4,5,8-naphthalenetetracarboxylic diimide} (16.2 g, 33.5 mmol), butylacrylate(2.5 g, 19.5 mmol), 4-hydroxybutylacrylate (1.1 g, 7.6 mmol). The flask was flushed with argon, toluene added (33 mL), and the flask heated in an oil bath at 95° C. to form a clear solution. The initiator 1,1'-azobis(cyclohexanecarbonitrile)(Vazo™ 88) (0.50 g) was added in a toluene solution (3 mL) and the heating continued for 18 h. The reaction was allowed to cool, tetrahydrofuran(200 mL) added, and the polymer precipitated into methanol/ethyl acetate (1/1)vol, collected and dried in a vacuum oven overnight.

Polymer 5

Poly{N-butyl-N'-[2-(ethoxy-2-acrylate)ethyl]-1,4,5,8-naphthalene-tetracarboxylic diimide}$_{37}${N-hexyl-N'-[2-(ethoxy-2-acrylate)ethyl]-1,4,5,8-naphthalenetetracarboxylic diimide}$_{35}$[butyl acrylate]$_{21}$[hydroxybutyl acrylate]$_8$. A 250-mL three neck round bottom flask with a magnetic stir bar was charged with 13.9 grams of Polymer 4 and 100 grams of toluene. The mixture was stirred for half an hour to become a clear orange solution and then was cooled to 0° C. To the solution 0.3 grams of triethyl amine in 2 grams of toluene was added, followed by 0.26 grams of acryloyl chloride in 2 grams of toluene. The mixture was stirred for 5 minutes and filtered through a Celite layer on a frit. The orange filtrate solution was then precipitated into heptane/ethyl acetate (2/1 vol). The isolated polymer was dried in a vacuum oven at 80° C. overnight. The polymer may be re-precipitated if there is any contamination in the product. Total yield: 10.4 g; $M_n$: 13200; $M_w$: 22300; $T_g$: 78° C.; containing 0.13 mmol/g vinyl group.

Example 4

A photoconductive element is prepared substantially as described in Comparative Example 1, except that the barrier layer was formulated with Polymer 5 as follows in Table 7:

TABLE 7

Formulation of Polymer 5

| Composition | Percentage (%) |
|---|---|
| Polymer 5 | 85 |
| CN968 | 10 |
| Irgacure 184 | 5 |
| TOTAL | 100 |

Where CN968 is an aliphatic polyester based urethane hexaacrylate oligomer from Sartomer and Irgacure 184 is 1-hydroxy-cyclohexyl-phenyl ketone, a photoinitiator from Ciba Speciality Chemicals.

The barrier layer solution is prepared at 10 wt % solid in tetrahydrofuran. The barrier layer with Polymer 5 was web coated at a dry coverage of 0.1 g/ft$^2$. The barrier layer coatings were cured under H-type Ultra-violet (UV) bulb. The energy of the UV source is 500 mJ/cm$^2$ per pass. The barrier coatings were cured at 1, 4 and 8 passes under UV light, respectively. The cured samples were extracted with 1,1,2-trichloroethane for 3 minutes and the UV/Visible spectrum of the supernatant obtained to determine the amount of material that remained soluble after crosslinking. The absorbance at 350-400 nm was ascribed to the naphthalene bisimide moiety. The extraction results are as following:

TABLE 8

Extraction of Uncrosslinked Naphthalene Bisimide Moieties from Coating with Increasing UV Cure

| Barrier coatings | Coating thickness | UV passes | Supernatant absorbance |
|---|---|---|---|
| Experiment 4A | 1.0 μm | 1 | 0.2 |
| Experiment 4B | 1.0 μm | 4 | 0.08 |
| Experiment 4C | 1.0 μm | 8 | 0.09 |

The above extraction results indicate that Polymer 5 is crosslinked quickly and efficiently under predetermined UV curing condition. The amounts of naphtlalene bisimide moiety extracted from UV cured materials are relatively low and decrease with multiple passes under UV light. The UV cured barrier layer prevents contamination of naphthalene bisimide moieties to other layers of the photoreceptor.

The barrier layer 4C was overcoated with CGL and CTL as described in Comparative Example 1. The photoreceptor is evaluated in a laboratory apparatus that charges, exposes and erases the film continuously. The photoreceptor is found to have good transporting properties and the results are shown as the following Table 9.

TABLE 9

Unexposed ($V_0$) and Exposed ($V_{toe}$) Voltages up to 10000 cycles.

| Cycle | $V_0$ (volts) | $V_{toe}$ (volts) |
|---|---|---|
| 1 | −500 | −40 |
| 1000 | −490 | −50 |
| 2000 | −490 | −60 |
| 3000 | −490 | −70 |
| 4000 | −490 | −80 |
| 5000 | −490 | −90 |
| 6000 | −490 | −100 |
| 7000 | −490 | −100 |
| 8000 | −480 | −100 |
| 9000 | −490 | −100 |
| 10,000 | −490 | −100 |

Polymer 6

Poly{N-butyl-N'-[2-(ethoxy-2-acrylate)ethyl]-1,4,5,8-naphthalene-tetracarboxylic diimide}$_{38}$\{N-octyl-N'-[2-(ethoxy-2-acrylate)-ethyl]-1,4,5,8-naphthalenetetracarboxylic diimide\}$_{19}$[hydroxyethyl methacrylate]$_{43}$.

A 250-mL three neck round bottom flask with a magnetic stir bar was charged with {N-(n-butyl)-N'-[2-(ethoxy-2-acrylate)ethyl]-1,4,5,8-naphthalenetetracarboxylic diimide} (10.6 g, 22.8 mmol), {N-(n-octyl)-N'-[2-(ethoxy-2-acrylate) ethyl]-1,4,5,8-naphthalenetetracarboxylic diimide} (6.0 g, 11.5 mmol) and hydroxyethyl methacrylate (3.4 g, 26.1 mmol). The flask was flushed with argon and toluene was added (150 ml), and the flask heated in an oil bath at 80° C. to form a clear solution. A mixture of initiator Vazo™ 52 (0.3 g) and Vazo™ 67 (0.2 g) was added together with 5 g of toluene. The reaction was heated to 60° C. for 2 hours, 70° C. for 16 hours, 80° C. for 1 hour and up to 100° C. for 2 hours. The reaction was then cooled to 0° C. and 1.8 grams of triethylamine was added, followed by 1.55 grams of acryloyl chloride in 5 grams of toluene. The mixture was stirred for 5 minutes and filtered through a Celite layer on a frit. The orange filtrate solution was then precipitated into methanol. The isolated polymer was dried in a vacuum oven at 80° C. overnight. The polymer may be re-precipitated if any contamination was found in the product. Total yield: 9.4 g; Mn: 6010; Mw: 14700; Tg: 73° C.; containing 0.70 mmol/g vinyl group.

Example 5

A photoconductive element is prepared substantially as described in Comparative Example 1, except that the barrier layer was formulated with Polymer 6 as shown in Table 10.

TABLE 10

Formulation of Polymer 6

| Composition | Percentage (%) |
|---|---|
| Polymer 6 | 60 |
| CN968 | 30 |
| Irgacure 184 | 10 |
| TOTAL | 100 |

The barrier layer solution is prepared at 10 wt % solid in tetrahydrofuran. The barrier layer with Polymer 6 was web coated at a dry coverage of 0.05 g/ft$^2$. The barrier layer coatings were cured under H-type Ultra-violet (UV) bulb. The energy of the UV source is 500 mJ/cm$^2$ per pass. The barrier coatings were cured at 1 and 6 passes under UV light, respectively. The cured samples were extracted with 1,1,2-trichloroethane for 3 minutes and the UV/Visible spectrum of the supernatant obtained to determine the amount of material that remained soluble after crosslinking. The absorbance at 350-400 nm was ascribed to the naphthalene bisimide moiety. The extraction results are as shown in Table 11. The supernatant absorbance at 380 nm is reported in Table 11.

TABLE 11

Extraction of Uncrosslinked Naphthalene Bisimide Moieties from Coating with Increasing UV Cure

| Barrier coatings | Coating thickness | UV passes | Supernatant absorbance |
|---|---|---|---|
| Experiment 5A | 0.5 μm | 1 | 0.11 |
| Experiment 5B | 0.5 μm | 6 | 0.01 |

The above extraction results indicate that Polymer 6 is crosslinked quickly and efficiently under predetermined UV curing condition. The amounts of naphthalene bismide moiety extracted from UV cured materials are very low and decrease with multiple passes under UV light. Similar to Experiment 5, The UV cured barrier layer of Experiment 6 also prevents contamination of NB moieties to other layers of the photoreceptor.

The barrier layer 5B was overcoated with CGL and CTL as described in Comparative Example 1. The photoreceptor is evaluated in a laboratory apparatus that charges, exposes and erases the film continuously. The photoreceptor is found to have good transporting properties and the results are shown in Table 12

TABLE 12

Unexposed ($V_0$) and Exposed ($V_{toe}$) Voltages up to 1000 cycles

| Cycle | $V_0$ (volts) | $V_{toe}$ (volts) |
|---|---|---|
| 1 | −540 | −40 |
| 100 | −530 | −50 |
| 200 | −520 | −60 |
| 300 | −510 | −60 |
| 400 | −500 | −70 |
| 500 | −490 | −70 |
| 600 | −490 | −70 |
| 700 | −490 | −70 |
| 800 | −490 | −70 |
| 900 | −490 | −70 |
| 1000 | −480 | −70 |

Polymer 7

Poly{N-butyl-N'-[2-(2-ethyl)ethoxyacrylate]-1,4,5,8-naphthalenetetra-carboxylic diimide}$_{40}$\{N-hexyl-N'-[2-(2-ethyl)ethoxyacrylate]-1,2,5,8-naphthalenetetracarboxylic diimide\}$_{40}$\{N-(hydroxyl-n-pentyl)-N'-[n-pentyl-acrylate]-1,4,5,8-naphthalenetetracarboxylic diimide\}$_{40}$. A 100-mL three neck round bottom flask with a magnetic stir bar was charged with {N-(n-butyl)-N'-[2-(ethoxy-2-acrylate)ethyl]-1,4,5,8-naphthalenetetracarboxylic diimide} (4.8 g, 10.3 mmol), {N-(n-hexyl)-N'-[2-(ethoxy-2-acrylate)ethyl]-1,4,5,8 -naphthalenetetracarboxylic diimide} (4.80 g, 4.9 mmol), {N-(hydroxyl-n-pentyl)-N'-[n-pentylacrylate]-1,4,5,8-naphthalenetetracarboxylicbisimide} (2.4 g, The flask was flushed with argon, toluene added (10 mL), and the flask heated in an oil bath at 95° C. to form a clear solution. The initiator 1,1'-azobis(cyclohexanecarbonitrile) (Vazo™ 88) (0.18 g) was added in a toluene solution (3 mL) and the heating continued for 18 h. The reaction was allowed to cool, dichloromethane (60 mL) added, and the polymer precipitated into methanol. The product (15.2 g) was precipitated a second time from tetrahydrofuran (100 mL) into methanol/ethyl acetate (1/1)vol. The polymer was an orange powder. $M_n$ 6650, $M_w$ 18,600, $T_g$ 99° C. hydroxyl number 0.36 meq/g.

Example 6

A photoconductive element is prepared from Polymer 7 for use in dip coating. The barrier layer solution is prepared at 10 wt % in 1,1,2-trichoroethane. The crosslinking agent and catalyst amounts were added as shown in Table 13. An Amilan™ control prepared by web coating as described in Comparative Example 1 was overcoated in the same way as Polymer 3.

TABLE 13

Formulation of Polymer 7

| Component | Weight (g) |
|---|---|
| Polymer 7 | 8.01 |
| Trixene BI 7963 | 0.9 |
| Dibutyltin dilaurate | 0.09 |
| 1,1,2-TCE | 81 |

The 1,1,2-trichloroethane solution contained 10 wt % solids of a total solution weight of 90 g or a total solution volume of 62.5 mL.

The Polymer 7 layer was web coated at a dry coverage of 0.20 g/ft$^2$, the Amilan™ layer at 0.05 g/ft$^2$. The samples were cured at 135° C. for 24 hours. They were overcoated with CGL and CTL as described in Comparative Example 1.

Evaluation

The films are tested in a laboratory apparatus that charges, exposes and erases the film continuously. The initial and residual or "toe" voltage at the beginning of the test and after 10,000 cycles is recorded for each film. The results shown in Table 14 show that the photoconductive elements corresponding to example of the invention outperform those of the comparative examples.

TABLE 14

Unexposed ($V_0$) and Exposed ($V_{toe}$) Voltages at 20 C. and 20% RH

| Cycle | Amilan ™ | | Polymer 2 | |
|---|---|---|---|---|
| $V_0$(volts) | $V_0$(volts) | $V_{toe}$(volts) | $V_0$(volts) | $V_{toe}$(volts) |
| 1 | −600 | −20 | −600 | −25 |
| 100 | −560 | −40 | −550 | −25 |
| 200 | −580 | −50 | −560 | −25 |
| 300 | −580 | −60 | −570 | −25 |
| 400 | −590 | −70 | −580 | −25 |
| 500 | −580 | −70 | −570 | −25 |
| 600 | −590 | −80 | −580 | −25 |
| 700 | −590 | −100 | −590 | −25 |
| 800 | −580 | −120 | −580 | −25 |
| 900 | −570 | −100 | −560 | −25 |
| 1000 | −610 | −100 | −620 | −25 |

This film was found to have the best electrical properties of the naphthalene bisimide films tested, and the best crosslinking of all the films. It had the lowest amount of extractions.

The invention has been described in detail with particular reference to certain preferred embodiments thereof, but it will be understood that variations and modifications can be effected within the spirit and scope of the invention.

The invention claimed is:

1. A photoconductive element comprising an electrically conductive support, an electrical barrier layer disposed over said electrically conductive support, and disposed over said barrier layer, a charge generation layer capable of generating charge carriers when exposed to actinic radiation, said barrier layer comprising a crosslinker and a polymer comprising the formula:

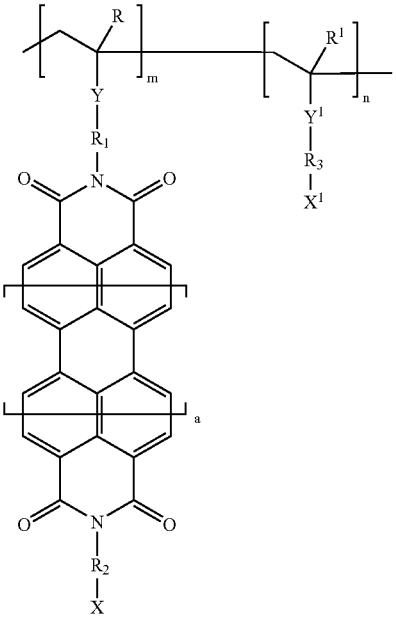

wherein:

a is 0 or 1;

R and R' independently represent H, $CH_3$, $CH_2CO_2R_4$ where $R_4$ represents an alkyl group $R_1$ and $R_2$ and $R_3$ independently represent alkylene or alkyleneoxy groups having from about 2 to 12 atoms;

X and X' independently represent H, —OH, —$CO_2H$, —OC(O)CH═$CH_2$;

Y and Y' independently represent bridging moieties such as —$C_6H_4$—and —OC(O)—, wherein m and n are numbers between 1 and 100 and (m+n=100) which represents the mole percentage of monomer repeat units in the polymer, and wherein the polymer has a molecular weight of between 5000 and 500,000 amu.

2. The photoconductive element of claim 1 wherein said crosslinker comprises diethylmalonate blocked isocyanates.

3. A photoconductive element comprising an electrically conductive support, an electrical barrier layer disposed over said electrically conductive support, and disposed over said barrier layer, a charge generation layer capable of generating charge carriers when exposed to actinic radiation, said barrier layer comprising a polymer comprising the formula:

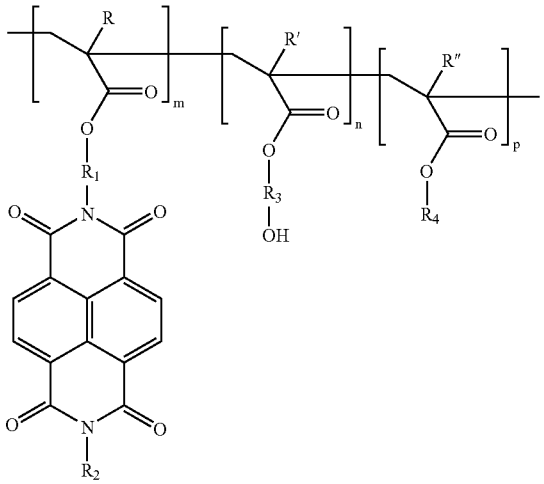

wherein:

R, R', and R" independently represent H or $CH_3$;

$R_1$ and $R_3$ independently represent alkylene or alkyleneoxy groups having from about 2 to 12 atoms;

$R_2$ and $R_4$ independently represent alkyl, alkyl aryl, substitued alkyl or substitued alkyl aryl;

m, n and p are numbers between 1 and 100, wherein (m+n+p=100) representing the mole percentage of monomer repeat units in the polymer where m is a number between 50 and 99 and n+p is a number between 1 and 50, and wherein the polymer has a molecular weight of between 5000 and 500,000 amu.

4. The photoconductive element of claim 3 wherein $R_1$ comprises ethylene, propylene, butylene, pentylene, hexylene, octylene, or ethoxyethylene; $R_2$ comprises methyl, ethyl, propyl, butyl, pentyl, hexyl, octyl, or ethoxypropyl; $R_3$ comprises ethylene, propylene, butylene, pentylene, hexylene, octylene, ethoxyethylene, isobutylene, or ethoxyethylene repeated between 1 and 5 times, $R_4$ comprises methyl, ethyl, propyl, butyll, pentyl, hexyl, octyl, or ethoxypropyl, m is a number between 60 and 98 and n+p is a number between 2 and 38.

5. A photoconductive element comprising an electrically conductive support, an electrical barrier layer disposed over said electrically conductive support, and disposed over said barrier layer, a charge generation layer capable of generating charge carriers when exposed to actinic radiation, said barrier layer comprising a polymer comprising the formula:

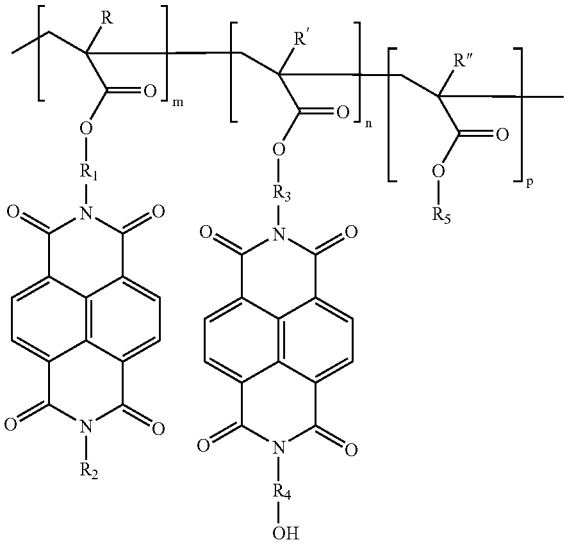

wherein:

R, R' and R" independently represents H or $CH_3$;

$R_1$ and $R_3$ and $R_4$ independently represent alkylene or alkyleneoxy groups having from about 2 to 12 atoms;

$R_2$ and $R_5$ independently represent alkyl, alkyl aryl, substituted alkyl, or substituted alkyl aryl;

m, n and p are numbers between 1 and 100 representing the mole percentage of monomer repeat units in the polymer where m is a number between 50 and 99 and n+p is a number between 1 and 50, wherein m+n+p=100 and the polymer has a molecular weight of between 5000 and 500,000 amu.

6. The photoconductive element of claim 5 wherein $R_1$ and $R_3$ comprise ethylene, propylene, butylene, pentylene, hexylene octylene, or ethoxyethyl; $R_2$ and $R_5$ comprise methyl, ethyl, propyl, butyl, pentyl, hexyl, octyl, or ethoxypropyl; $R_4$ comprise ethylene, propylene, butylene, pentylene, hexylene, octylene, ethoxyethylene isobutylene, or ethoxyethylene repeated between 1 and 5 times, m is a number between 60 and 98 and n is a number between 2 and 40, and the molecular weight is between 8000 and 200,000 amu.

7. The photoconductive element of claim 5 wherein said barrier layer further comprises a crosslinker.

8. The photoconductive element of claim 7 wherein said crosslinker comprises diethylmalonate blocked isocyanates.

9. A photoconductive element comprising an electrically conductive support, an electrical barrier layer disposed over said electrically conductive support, and disposed over said barrier layer, a charge generation layer capable of generating charge carriers when exposed to actinic radiation, said barrier layer comprising a polymer comprising the fonnula:

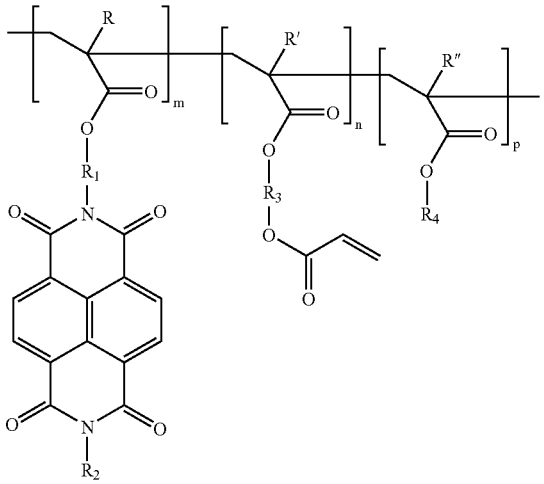

wherein:

R, R', and R" independently represent H or $CH_3$;

$R_1$ and $R_3$ independently represent alkylene or alkyleneoxy groups having from about 2 to 12 atoms;

$R_2$ and $R_4$ represent alkyl, alkyl aryl, substituted alkyl, or

And m, n and p are numbers between 1 and 100 representing the mole percentage of monomer repeat units in the polymer where m is a number between 50 and 99 and n+p is a number between 1 and 49, where m+n+p=100 and the polymer is has a molecular weight of between 5000 and 500,000.

10. The photoconductive element of claim 9 wherein $R_1$ comprises ethylene, propylene, butylene, pentylene, hexylene; octylene, or ethoxyethylene; $R_2$ and $R_4$ comprise methyl, ethyl, propyl, butyl, pentyl, hexyl, octyl, or ethoxypropyl; $R_3$ comprises ethylene, propylene, butylene, isobutylene, ethoxyethylene repeated between 1 and 5 times, m is a number between 60 and 98 and n+p is a number between 2 and 38, and the molecular weight is between 8000 and 200,000 amu.

11. The photoconductive element of claim 9 wherein said barrier layer further comprises an ultra violet crosslinking agent.

12. A photoconductive element comprising an electrically conductive support, an electrical barrier layer disposed over said electrically conductive support, and disposed over said barrier layer, a charge generation layer capable of generating positive charge carriers when exposed to actinic radiation, said barrier layer comprising an ultra violet crosslinking agent and a polymer comprising the formula:

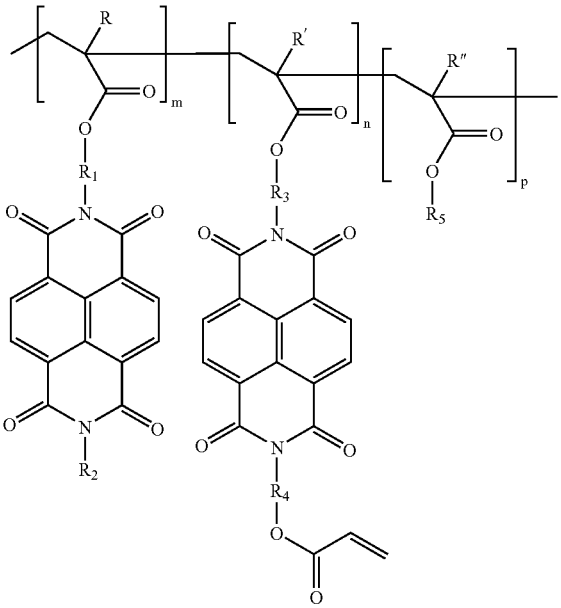

wherein:

R and R' independently represent H or $CH_3$;

$R_1$ and $R_3$ and $R_4$ independently represent alkylene or alkyleneoxy groups having from about 2 to 12 atoms;

$R_2$ and $R_5$ represents alkyl, alkyl aryl, substituted alkyl, or substituted alkyl aryl; m and n are numbers between 1 and 100 representing the mole percentage of monomer repeat units in the polymer where m is a number between 50 and 100 and n+p is a number between 0 and 50, where m+n+p=100 the polymer has a molecular weight of between 5000 and 500,000 amu.

13. The photoconductive element of claim 12 wherein Ri comprises ethyl, propyl, butyl, pentyl, hexyl, octyl, or ethoxyethyl; $R_2$ comprises ethyl, propyl, butyl, pentyl, hexyl, octyl, or ethoxypropyl; $R_3$ comprises methyl, ethyl, butyl, isobutyl, ethoxyethyl repeated between 1 and 10 times, m is a number between 60 and 98 and n is a number between 2 and 38, and the molecular weight is between 8000 and 200,000 amu.

14. The photoconductive element of claim 12 wherein the electrically conductive support comprises a flexible material having a layer of metal disposed thereon.

15. The photoconductive element of claim 14 wherein the layer of metal is nickel.

16. The photoconductive element of claim 14 wherein the layer of metal is aluminum, anodized aluminum, filled anodized aluminum, or similar structures.

17. The photoconductive element of claim 12 wherein the barrier layer has a thickness of between 0.5 and 5 micrometers.

18. A method of forming an image comprising providing a photoreceptor, charging said photoreceptor, exposing said photoreceptor to actinic radiation, developing said image with a toner, and transferring said image to a receiver sheet, wherein the photoreceptor comprises an electrically conductive support, an electrical barrier layer disposed over said electrically conductive support, and disposed over said barrier layer, a charge generation layer capable of generating charge carriers when exposed to actinic radiation, said barrier layer comprising a crosslinking agent and a polymer comprising the formula:

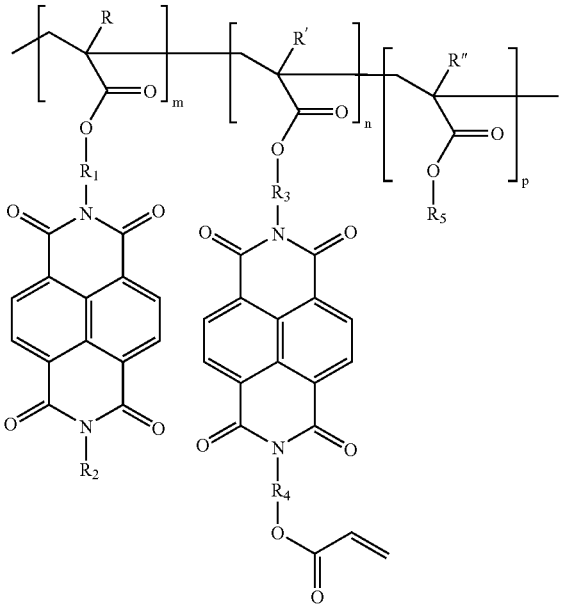

wherein:

R and R' independently represent H or $CH_3$;

$R_1$ and $R_3$ and $R_4$ independently represent alkylene or alkyleneoxy groups having from about 2 to 12 atoms;

$R_2$ and $R_5$ represents alkyl, alkyl aryl, substituted alkyl, or substituted alkyl aryl; m and n are numbers between 1 and 100 representing the mole percentage of monomer repeat units in the polymer where m is a number between 50 and 100 and n+p is a number between 0 and 50, where m+n+p=100 the polymer has a molecular weight of between 5000 and 500,000 amu.

* * * * *

UNITED STATES PATENT AND TRADEMARK OFFICE

CERTIFICATE OF CORRECTION

PATENT NO. : 7,371,492 B2
APPLICATION NO. : 11/192347
DATED : May 13, 2008
INVENTOR(S) : Wayne T. Ferrar et al.

It is certified that error appears in the above-identified patent and that said Letters Patent is hereby corrected as shown below:

Column 34, line 59, claim 1, delete "$CH_{2;}$" and insert -- $CH_2$; --.

Column 35, line 62, claim 4, delete "butyll," and insert -- butyl, --.

Column 36, line 57, claim 6, delete "hexylene" and insert -- hexylene, --.

Column 36, line 60, claim 6, delete "ethoxyethylene" and insert -- ethoxyethylene, --.

Column 37, line 10, claim 9, delete "fonnula:" and insert -- formula --.

Column 37, line 52, claim 9, after "or" insert -- substituted alkyl aryl; --.

Column 37, line 54, claim 9, delete "And" and insert -- and --.

Column 37, line 59, claim 9, after "polymer" and before "has" delete "is".

Column 37, lines 62 - 63, claim 10, delete "hexy-lene;" and insert -- hexylene, --.

Column 39, line 1, claim 13, delete "$R_i$" and insert -- $R_1$ --.

Signed and Sealed this

Twenty-fifth Day of August, 2009

David J. Kappos

David J. Kappos
*Director of the United States Patent and Trademark Office*